US007484563B2

(12) United States Patent
Zazovsky et al.

(10) Patent No.: US 7,484,563 B2
(45) Date of Patent: Feb. 3, 2009

(54) FORMATION EVALUATION SYSTEM AND METHOD

(75) Inventors: Alexander F. Zazovsky, Houston, TX (US); Christopher S. Del Campo, Houston, TX (US); Ricardo Vasques, Sugar Land, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 142 days.

(21) Appl. No.: 11/219,244

(22) Filed: Sep. 2, 2005

(65) Prior Publication Data

US 2006/0000603 A1 Jan. 5, 2006

Related U.S. Application Data

(60) Continuation-in-part of application No. 10/711,187, filed on Aug. 31, 2004, now Pat. No. 7,178,591, and a continuation-in-part of application No. 11/076,567, filed on Mar. 9, 2005, now Pat. No. 7,090,012, which is a division of application No. 10/184,833, filed on Jun. 28, 2002, now Pat. No. 6,964,301.

(51) Int. Cl.
*E21B 49/08* (2006.01)

(52) U.S. Cl. ..... 166/264; 166/100; 175/59; 73/152.23

(58) Field of Classification Search ..... 166/264, 166/387, 386, 179, 191, 242.1, 100; 175/58, 175/59, 60; 73/152.17, 152.23, 152.24, 152.26
See application file for complete search history.

(56) References Cited

U.S. PATENT DOCUMENTS

| | | | |
|---|---|---|---|
| 3,121,459 | A | 2/1964 | Van Ness, Jr. et al. |
| 3,295,615 | A | 1/1967 | Brieger et al. |
| 3,323,361 | A | 6/1967 | Lebourg |
| 3,352,361 | A | 11/1967 | Urbanosky |
| 3,385,364 | A | 5/1968 | Whitten |

(Continued)

FOREIGN PATENT DOCUMENTS

GB 2400910 10/2004

(Continued)

OTHER PUBLICATIONS

Crombie, Alastair et al., Innovations inn Wireline Fluid Sampling, Oilfield Review, Autumn 1998, pp. 26-41.

(Continued)

*Primary Examiner*—Shane Bomar
(74) *Attorney, Agent, or Firm*—Dave R. Hofman; Darla Fonseca; Jaime Castano

(57) ABSTRACT

A method of evaluating a fluid from a subterranean formation drawn into a downhole tool positioned in a wellbore penetrating the subterranean formation is provided. The method involves drawing fluid from a formation into an evaluation flowline, drawing fluid from a formation into a cleanup flowline, measuring a property of the fluid in the evaluation flowline and detecting stabilization of the property of the fluid in the evaluation flowline. Fluid properties in a combined flowline may be generated from the evaluation and cleanup flowlines. The fluid properties of the combined flowline may be used to project future evaluation flowline fluid properties. Contamination levels for a given fluid property of a given flowline may also be determined.

44 Claims, 16 Drawing Sheets

U.S. PATENT DOCUMENTS 3,430,181 A 2/1969 Urbanosky
3,430,711 A 3/1969 Taggart
3,530,933 A 9/1970 Whitten
3,565,169 A 2/1971 Bell
3,611,799 A 10/1971 Lagus et al.
3,653,436 A 4/1972 Anderson et al.
3,677,081 A 7/1972 Newton et al.
3,782,191 A 1/1974 Whitten
3,813,936 A 6/1974 Urbanosky et al.
3,859,851 A 1/1975 Urbanosky
3,864,970 A 2/1975 Bell
3,924,463 A 12/1975 Urbanosky
3,934,468 A 1/1976 Brieger
3,952,588 A 4/1976 Whitten
4,246,782 A 1/1981 Hallmark
4,287,946 A 9/1981 Brieger
4,339,948 A 7/1982 Hallmark
4,369,654 A 1/1983 Hallmark
4,416,152 A 11/1983 Wilson
4,492,862 A 1/1985 Grynberg et al.
4,513,612 A 4/1985 Shalek
4,635,717 A * 1/1987 Jageler ..... 166/250.01
4,680,581 A 7/1987 Kozlik et al.
4,860,581 A 8/1989 Zimmerman et al.
4,879,900 A 11/1989 Gilbert
4,931,343 A 6/1990 Becker et al.
4,936,139 A 6/1990 Zimmerman et al.
4,951,749 A 8/1990 Carroll
4,994,671 A 2/1991 Safinya et al.
5,056,959 A 10/1991 Cannac et al.
5,166,747 A 11/1992 Schroeder et al.
5,230,244 A 7/1993 Gilbert
5,265,015 A 11/1993 Auzerais et al.
5,266,800 A 11/1993 Mullins
5,279,153 A 1/1994 Dussan V. et al.
5,303,775 A 4/1994 Michaels et al.
5,331,156 A 7/1994 Hines et al.
5,335,542 A 8/1994 Ramakrishnan et al.
5,337,838 A 8/1994 Sorensen
5,377,755 A 1/1995 Michaels et al.
5,587,525 A 12/1996 Shwe et al.
5,765,637 A 6/1998 Dietle et al.
5,770,798 A 6/1998 Georgi et al.
5,826,662 A 10/1998 Beck et al.
5,859,430 A 1/1999 Mullins et al.
5,923,171 A 7/1999 Koelman et al.
5,934,374 A 8/1999 Hrametz et al.
5,939,717 A 8/1999 Mullins
6,164,126 A 12/2000 Ciglenec et al.
6,176,323 B1 1/2001 Weirich et al.
6,178,815 B1 1/2001 Felling et al.
6,216,662 B1 4/2001 Sapsford
6,223,822 B1 5/2001 Jones
6,230,557 B1 5/2001 Ciglenec et al.
6,274,865 B1 8/2001 Schroer et al.
6,301,959 B1 10/2001 Hrametz et al.
6,343,507 B1 2/2002 Felling et al.
6,350,966 B1 2/2002 Potthof et al.
6,350,986 B1 2/2002 Mullins et al.
6,435,279 B1 8/2002 Howe et al.
6,437,326 B1 8/2002 Yamate et al.
6,467,544 B1 10/2002 Brown et al.
6,474,152 B1 11/2002 Mullins et al.
6,476,384 B1 11/2002 Mullins et al.
6,478,096 B1 11/2002 Jones et al.
6,568,487 B2 5/2003 Meister et al.
6,585,045 B2 7/2003 Lee et al.
6,609,568 B2 8/2003 Krueger et al.
6,627,873 B2 9/2003 Tchakarov et al.
6,658,930 B2 12/2003 Abbas
6,659,177 B2 12/2003 Bolze et al.
6,707,556 B2 3/2004 Turner et al.
6,714,872 B2 3/2004 DiFoggio et al.
6,719,049 B2 4/2004 Sherwood et al.
6,729,399 B2 5/2004 Follini et al.
6,745,835 B2 6/2004 Fields
6,768,105 B2 7/2004 Mullins et al.
6,905,241 B2 6/2005 Zazovsky et al.
2001/0035312 A1 11/2001 Han et al.
2002/0112854 A1 8/2002 Krueger et al.
2002/0185313 A1 12/2002 Jones et al.
2002/0189339 A1 12/2002 Montalvo et al.
2003/0042021 A1 3/2003 Bolze et al.
2003/0145652 A1 8/2003 Arian
2003/0217845 A1 11/2003 Sherwood et al.
2004/0000433 A1 1/2004 Hill et al.
2004/0083805 A1 5/2004 Ramakrishnan et al.
2004/0099443 A1 5/2004 Meister et al.
2004/0178336 A1 9/2004 DiFoggio
2005/0039527 A1 2/2005 Dhruva et al.
2005/0171699 A1 8/2005 Zazovsky et al.
2005/0182566 A1 8/2005 DiFoggio
2006/0000603 A1 1/2006 Zazovsky et al.

FOREIGN PATENT DOCUMENTS

WO WO9603628 10/1996
WO WO03098639 11/2003
WO WO2004020982 3/2004

OTHER PUBLICATIONS

Smits, A.R., In-Situ Optical Fluid Analysis as an Aid to Wireline Formation Sampling, SPE Formation Evaluation, Jun. 1995, pp. 91-98.
Mullins, Oliver C. et al., Real-Time Determination of OBM Filtrate Contamination During Openhole Wireline Sampling, E&P Exchange, Feb. 2001, pp. 24-26.
Mullins, Oliver C. et al., Optimization of Wireline Sample Quality by Real-Time Analysis of Oil-Based Mud Contamination—Examples from North Sea Operations, SPE 71736, pp. 1-16.
Dong, C. et al., In-Situ Contamination Monitoring and GOR Measurement of Formation Fluid Samples, SPE 77899, pp. 1-9.
Hammond, P.S., One- and Two-Phase Flow During Fluid Sampling by a Wireline Tool, Schlumberger Cambridge Research, pp. 299-330, Aug. 1989.
Mullins, Oliver C. et al., Real-Time Determination of Filtrate Contamination During Openhole Wireline Sampling by Optical Spectroscopy, Society of Petroleum Engineers 63071, pp. 1-13, Oct. 1-4, 2000.
Akram, A.H. et al., A Model to Predict Wireline Formation Tester Sample Contamination, Society of Petroleum Engineers 48959, pp. 27-33, Sep. 27-30, 1998.
Schlumberger Wireline & Testing, Schlumberger Wireline Formation Testing and Sampling, pp. 4-1 through 10-25, 1996.
Hashem, M.N. et al., Determination of Producible Hydrocarbon Type and Oil Quality in Wells Drilled with Synthetic Oil-Based Muds, SPE Reservoir Eval. & Eng. 2, pp. 125-133, Apr. 1999.

* cited by examiner

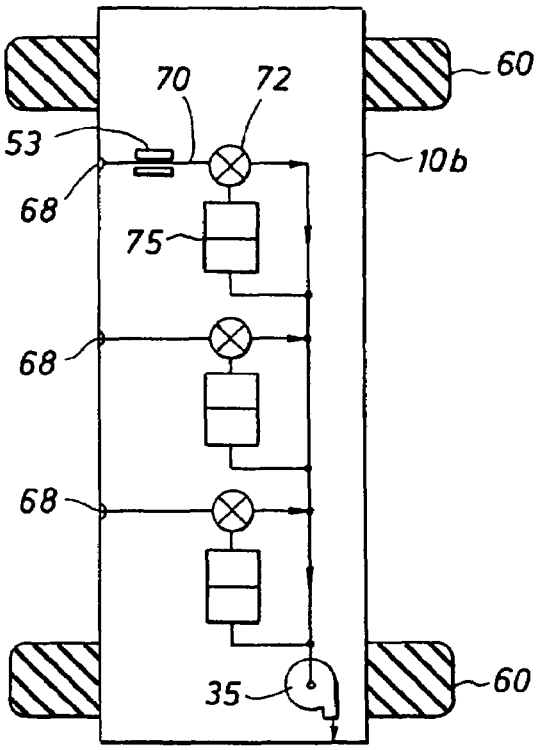
FIG.8C
FIG.11B
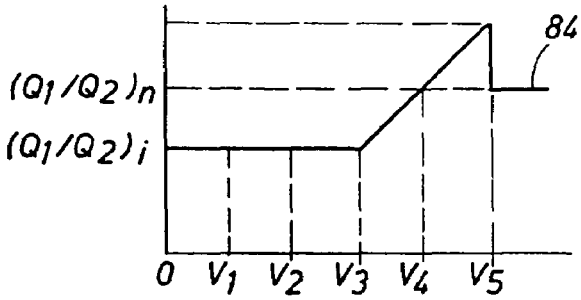
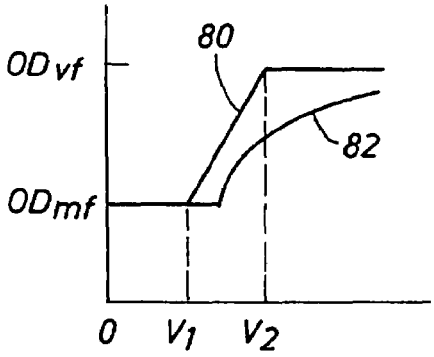
FIG.10
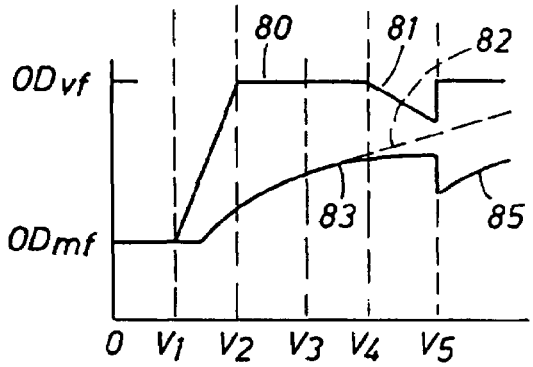
FIG.11A

FORMATION EVALUATION SYSTEM AND METHOD

CROSS-REFERENCE TO RELATED APPLICATIONS

This application is a continuation-in-part of U.S. application Ser. No. 10/711,187, filed on Aug. 31, 2004 now U.S. Pat. No. 7,178,591 and U.S. application Ser. No. 11/076,567 filed on Mar. 9, 2005 now U.S. Pat. No. 7,090,012 which is a divisional of U.S. application Ser. No. 10/184,833, filed Jun. 28, 2002 now U.S. Pat. No. 6,964,301.

BACKGROUND OF THE INVENTION

1. Field of the Invention

The present invention relates to techniques for performing formation evaluation of a subterranean formation by a downhole tool positioned in a wellbore penetrating the subterranean formation. More particularly, the present invention relates to techniques for reducing the contamination of formation fluids drawn into and/or evaluated by the downhole tool.

2. Background of the Related Art

Wellbores are drilled to locate and produce hydrocarbons. A downhole drilling tool with a bit at and end thereof is advanced into the ground to form a wellbore. As the drilling tool is advanced, a drilling mud is pumped through the drilling tool and out the drill bit to cool the drilling tool and carry away cuttings. The fluid exits the drill bit and flows back up to the surface for recirculation through the tool. The drilling mud is also used to form a mudcake to line the wellbore.

During the drilling operation, it is desirable to perform various evaluations of the formations penetrated by the wellbore. In some cases, the drilling tool may be provided with devices to test and/or sample the surrounding formation. In some cases, the drilling tool may be removed and a wireline tool may be deployed into the wellbore to test and/or sample the formation. In other cases, the drilling tool may be used to perform the testing or sampling. These samples or tests may be used, for example, to locate valuable hydrocarbons.

Formation evaluation often requires that fluid from the formation be drawn into the downhole tool for testing and/or sampling. Various devices, such as probes, are extended from the downhole tool to establish fluid communication with the formation surrounding the wellbore and to draw fluid into the downhole tool. A typical probe is a circular element extended from the downhole tool and positioned against the sidewall of the wellbore. A rubber packer at the end of the probe is used to create a seal with the wellbore sidewall. Another device used to form a seal with the wellbore sidewall is referred to as a dual packer. With a dual packer, two elastomeric rings expand radially about the tool to isolate a portion of the wellbore therebetween. The rings form a seal with the wellbore wall and permit fluid to be drawn into the isolated portion of the wellbore and into an inlet in the downhole tool.

The mudcake lining the wellbore is often useful in assisting the probe and/or dual packers in making the seal with the wellbore wall. Once the seal is made, fluid from the formation is drawn into the downhole tool through an inlet by lowering the pressure in the downhole tool. Examples of probes and/or packers used in downhole tools are described in U.S. Pat. Nos. 6,301,959; 4,860,581; 4,936,139; 6,585,045; 6,609,568 and 6,719,049 and US Patent Application No. 2004/0000433.

The collection and sampling of underground fluids contained in subsurface formations is well known. In the petroleum exploration and recovery industries, for example, samples of formation fluids are collected and analyzed for various purposes, such as to determine the existence, composition and producibility of subsurface hydrocarbon fluid reservoirs. This aspect of the exploration and recovery process can be crucial in developing drilling strategies and impacts significant financial expenditures and savings.

To conduct valid fluid analysis, the fluid obtained from the subsurface formation should possess sufficient purity, or be virgin fluid, to adequately represent the fluid contained in the formation. As used herein, and in the other sections of this patent, the terms "virgin fluid", "acceptable virgin fluid" and variations thereof mean subsurface fluid that is pure, pristine, connate, uncontaminated or otherwise considered in the fluid sampling and analysis field to be sufficiently or acceptably representative of a given formation for valid hydrocarbon sampling and/or evaluation.

Various challenges may arise in the process of obtaining virgin fluid from subsurface formations. Again with reference to the petroleum-related industries, for example, the earth around the borehole from which fluid samples are sought typically contains contaminates, such as filtrate from the mud utilized in drilling the borehole. This material often contaminates the virgin fluid as it passes through the borehole, resulting in fluid that is generally unacceptable for hydrocarbon fluid sampling and/or evaluation. Such fluid is referred to herein as "contaminated fluid." Because fluid is sampled through the borehole, mudcake, cement and/or other layers, it is difficult to avoid contamination of the fluid sample as it flows from the formation and into a downhole tool during sampling. A challenge thus lies in minimizing the contamination of the virgin fluid during fluid extraction from the formation.

FIG. 1 depicts a subsurface formation 16 penetrated by a wellbore 14. A layer of mud cake 15 lines a sidewall 17 of the wellbore 14. Due to invasion of mud filtrate into the formation during drilling, the wellbore is surrounded by a cylindrical layer known as the invaded zone 19 containing contaminated fluid 20 that may or may not be mixed with virgin fluid. Beyond the sidewall of the wellbore and surrounding contaminated fluid, virgin fluid 22 is located in the formation 16. As shown in FIG. 1, contaminates tend to be located near the wellbore wall in the invaded zone 19.

FIG. 2 shows the typical flow patterns of the formation fluid as it passes from subsurface formation 16 into a downhole tool 1. The downhole tool 1 is positioned adjacent the formation and a probe 2 is extended from the downhole tool through the mudcake 15 to the sidewall 17 of the wellbore 14. The probe 2 is placed in fluid communication with the formation 16 so that formation fluid may be passed into the downhole tool 1. Initially, as shown in FIG. 1, the invaded zone 19 surrounds the sidewall 17 and contains contamination. As fluid initially passes into the probe 2, the contaminated fluid 20 from the invaded zone 19 is drawn into the probe with the fluid thereby generating fluid unsuitable for sampling. However, as shown in FIG. 2, after a certain amount of fluid passes through the probe 2, the virgin fluid 22 breaks through and begins entering the probe. In other words, a more central portion of the fluid flowing into the probe gives way to the virgin fluid, while the remaining portion of the fluid is contaminated fluid from the invasion zone. The challenge remains in adapting to the flow of the fluid so that the virgin fluid is collected in the downhole tool during sampling.

Formation evaluation is typically performed on fluids drawn into the downhole tool. Techniques currently exist for performing various measurements, pretests and/or sample collection of fluids that enter the downhole tool. Various methods and devices have been proposed for obtaining subsurface fluids for sampling and evaluation. For example, U.S. Pat. No. 6,230,557 to Ciglenec et al., U.S. Pat. No. 6,223,822 to Jones, U.S. Pat. No. 4,416,152 to Wilson, U.S. Pat. No. 3,611,799 to Davis and International Pat. App. Pub. No. WO 96/30628 have developed certain probes and related techniques to improve sampling. However, it has been discovered that when the formation fluid passes into the downhole tool, various contaminants, such as wellbore fluids and/or drilling mud, may enter the tool with the formation fluids. These contaminates may affect the quality of measurements and/or samples of the formation fluids. Moreover, contamination may cause costly delays in the wellbore operations by requiring additional time for more testing and/or sampling. Additionally, such problems may yield false results that are erroneous and/or unusable. Other techniques have been developed to separate virgin fluids during sampling. For example, U.S. Pat. No. 6,301,959 to Hrametz et al. and discloses a sampling probe with two hydraulic lines to recover formation fluids from two zones in the borehole. Borehole fluids are drawn into a guard zone separate from fluids drawn into a probe zone. Despite such advances in sampling, there remains a need to develop techniques for fluid sampling to optimize the quality of the sample and efficiency of the sampling process.

It is, therefore, desirable that the formation fluid entering into the downhole tool be sufficiently 'clean' or 'virgin' for valid testing. In other words, the formation fluid should have little or no contamination. Attempts have been made to eliminate contaminates from entering the downhole tool with the formation fluid. For example, as depicted in U.S. Pat. No. 4,951,749, filters have been positioned in probes to block contaminates from entering the downhole tool with the formation fluid. Additionally, as shown in U.S. Pat. No. 6,301,959 to Hrametz, a probe is provided with a guard ring to divert contaminated fluids away from clean fluid as it enters the probe.

Despite the existence of techniques for performing formation evaluation and for attempting to deal with contamination, there remains a need to manipulate the flow of fluids through the downhole tool to reduce contamination as it enters and/or passed through the downhole tool. It is desirable that such techniques are capable of diverting contaminants away from clean fluid. It is further desirable that such techniques be capable of one of more of the following, among others: analyzing the fluid passing through the flowlines, selectively manipulating the flow of fluid through the downhole tool, responding to detected contamination, removing contamination and/or providing flexibility in handling fluids in the downhole tool.

In considering existing technology for the collection of subsurface fluids for sampling and/or evaluation, there remains a need for techniques capable of providing one or more, among others, of the following attributes: the ability to selectively collect virgin fluid apart from contaminated fluid; the ability to separate virgin fluid from contaminated fluid; the ability to optimize the quantity and/or quality of virgin fluid extracted from the formation for sampling; the ability to adjust the flow of fluid according to the sampling needs; the ability to control the sampling operation manually and/or automatically and/or on a real-time basis.

Techniques have also been developed to evaluate fluid passing through the tool to determine contamination levels. In some cases, techniques and mathematical models have been developed for predicting contamination for a merged flowline. See, for example, Published PCT Application No. WO 2005065277 and PCT Application No. 00/50876, the entire contents of which are hereby incorporated by reference. Techniques for predicting contamination levels and determining cleanup times are described in P. S. Hammond, "One or Two Phased Flow During fluid Sampling by a Wireline Tool," *Transport in Porous Media*, Vol. 6, p. 299-330 (1991), the entire contents of which are hereby incorporated by reference. Hammond describes a semi-empirical technique for estimating contamination levels and cleanup time of fluid passing into a downhole tool through a single flowline.

While techniques have been developed for contamination monitoring, such techniques relate to single flowline applications. It is desirable to provide contamination monitoring techniques applicable to multi-flowline operations. It is further desirable that such techniques provide one or more of the following capabilities: analyzing the fluid flow to detect contamination levels, estimate time to clean up contamination, calibrate flowline measurements, cross-check flowline measurements, selectively combine and/or separate flowlines, determining contamination levels and compare flowline data to known values. To this end, the present invention seeks to optimize the formation evaluation process.

SUMMARY OF THE INVENTION

In one aspect, the invention relates to a method of evaluating a fluid from a subterranean formation drawn into a downhole tool positioned in a wellbore penetrating the subterranean formation. This method involves drawing fluid from a formation into an evaluation flowline, drawing fluid from a formation into a cleanup flowline, measuring at least one property of the fluid in the evaluation flowline and detecting stabilization of the property(ies) of the fluid in the evaluation flowline.

In another aspect, the invention relates to a method of evaluating a fluid from a subsurface formation drawn into a downhole tool positioned in a wellbore penetrating the subterranean formation. The method involves drawing fluid from the formation into an evaluation flowline, drawing fluid from a formation into a cleanup flowline, generating a combined flowline from the evaluation and cleanup flowlines, determining a virgin fluid break through property (Pmf) and a virgin fluid property (Pvf) for the combined flowline, measuring at least one fluid property of one of the evaluation flowline, the cleanup flowline and/or the combined flowline and determining a contamination level for the at least one fluid property from the virgin fluid breakthrough parameter (Pmf), the virgin fluid property (Pvf) and the measured fluid property (Pd).

In yet another aspect, the invention relates to a method of evaluating a fluid from a subsurface formation drawn into a downhole tool positioned in a wellbore penetrating the subterranean formation. The method involves drawing fluid from the formation into an evaluation flowline, drawing fluid from a formation into a cleanup flowline, generating a combined flowline from the evaluation and cleanup flowlines, determining at least one initial fluid property of the fluid in the combined flowline for an initial period of time, estimating at least one projected combined parameter of the fluid for a future period of time for the combined flowline, estimating at least one projected evaluation parameter of the fluid for the evaluation flowline for the future period of time based on the estimated projected combined parameter and determining the time when the projected evaluation parameter reaches a target contamination level.

Other features and advantages of the invention will be apparent from the following description and the appended claims.

BRIEF DESCRIPTION OF THE DRAWINGS

For a detailed description of preferred embodiments of the invention, reference will now be made to the accompanying drawings wherein:

FIG. 8C is a schematic view of the flow section of the downhole tool of FIG. 8A.

FIG. 10 is a graphical depiction of the optical density signatures of fluid entering the probe at a given volume.

FIG. 11A is a graphical depiction of optical density signatures of FIG. 10 deviated during sampling at a given volume.

FIG. 11B is a graphical depiction of the ratio of flow rates corresponding to the given volume for the optical densities of FIG. 11A.

DETAILED DESCRIPTION OF THE INVENTION

Figure 1:
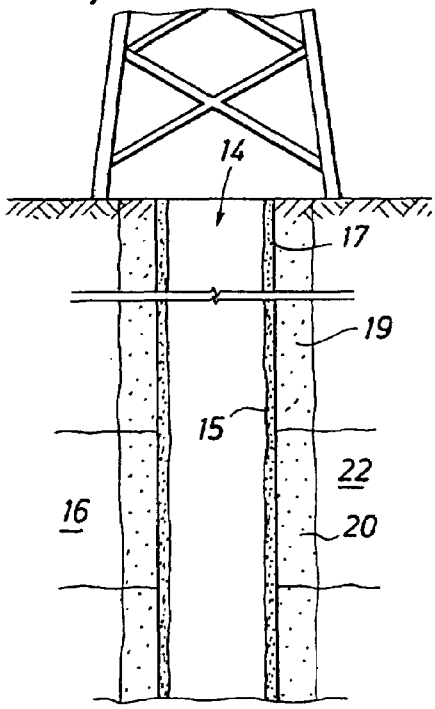
FIG. 1 (PRIOR ART)
FIG. 1 is a schematic view of a subsurface formation penetrated by a wellbore lined with mudcake, depicting the virgin fluid in the subsurface formation.

Presently preferred embodiments of the invention are shown in the above-identified figures and described in detail below. In describing the preferred embodiments, like or identical reference numerals are used to identify common or similar elements. The figures are not necessarily to scale and certain features and certain views of the figures may be shown exaggerated in scale or in schematic in the interest of clarity and conciseness.

Figure 3:
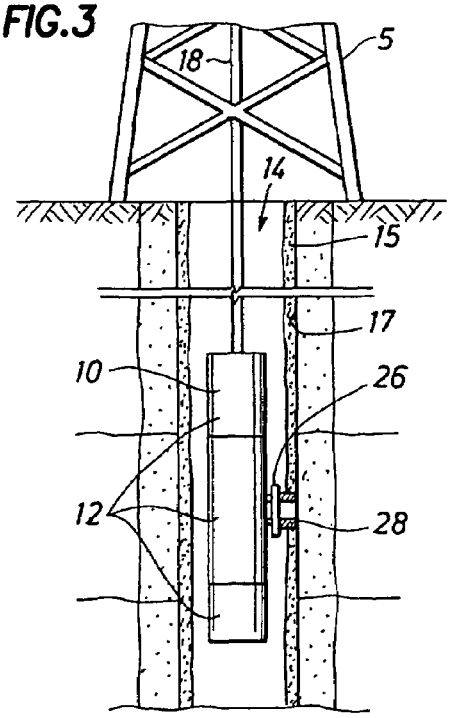
FIG. 3 is a schematic view of down hole wireline tool having a fluid sampling device.

Referring to FIG. 3, an example environment within which the present invention may be used is shown. In the illustrated example, the present invention is carried by a down hole tool 10. An example commercially available tool 10 is the Modular Formation Dynamics Tester (MDT) by Schlumberger Corporation, the assignee of the present application and further depicted, for example, in U.S. Pat. Nos. 4,936,139 and 4,860,581 hereby incorporated by reference herein in their entireties.

The downhole tool 10 is deployable into bore hole 14 and suspended therein with a conventional wire line 18, or conductor or conventional tubing or coiled tubing, below a rig 5 as will be appreciated by one of skill in the art. The illustrated tool 10 is provided with various modules and/or components 12, including, but not limited to, a fluid sampling device 26 used to obtain fluid samples from the subsurface formation 16. The fluid sampling device 26 is provided with a probe 28 extendable through the mudcake 15 and to sidewall 17 of the borehole 14 for collecting samples. The samples are drawn into the downhole tool 10 through the probe 28.

Figure 4:
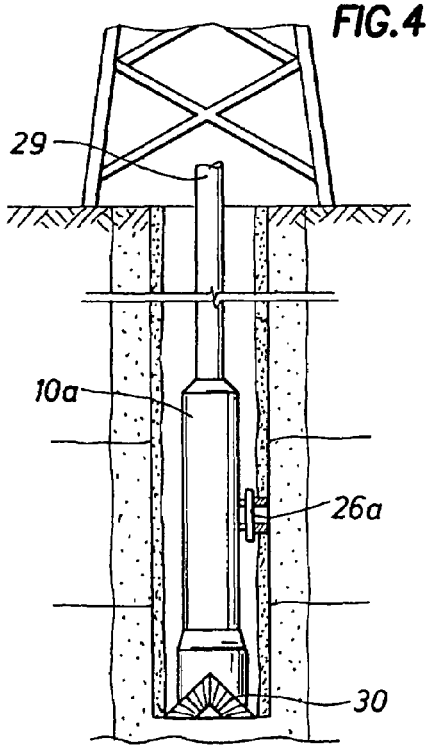
FIG. 4 is a schematic view of a downhole drilling tool with an alternate embodiment of the fluid sampling device of FIG. 3.

While FIG. 3 depicts a modular wireline sampling tool for collecting samples according to the present invention, it will be appreciated by one of skill in the art that such system may be used in any downhole tool. For example, FIG. 4 shows an alternate downhole tool 10*a* having a fluid sampling system 26*a* therein. In this example, the downhole tool 10*a* is a drilling tool including a drill string 29 and a drill bit 30. The downhole drilling tool 10*a* may be of a variety of drilling tools, such as a Measurement-While-Drilling (MWD), Logging-While Drilling (LWD) or other drilling system. The tools 10 and 10*a* of FIGS. 3 and 4, respectively, may have alternate configurations, such as modular, unitary, wireline, coiled tubing, autonomous, drilling and other variations of downhole tools.

Figure 5:
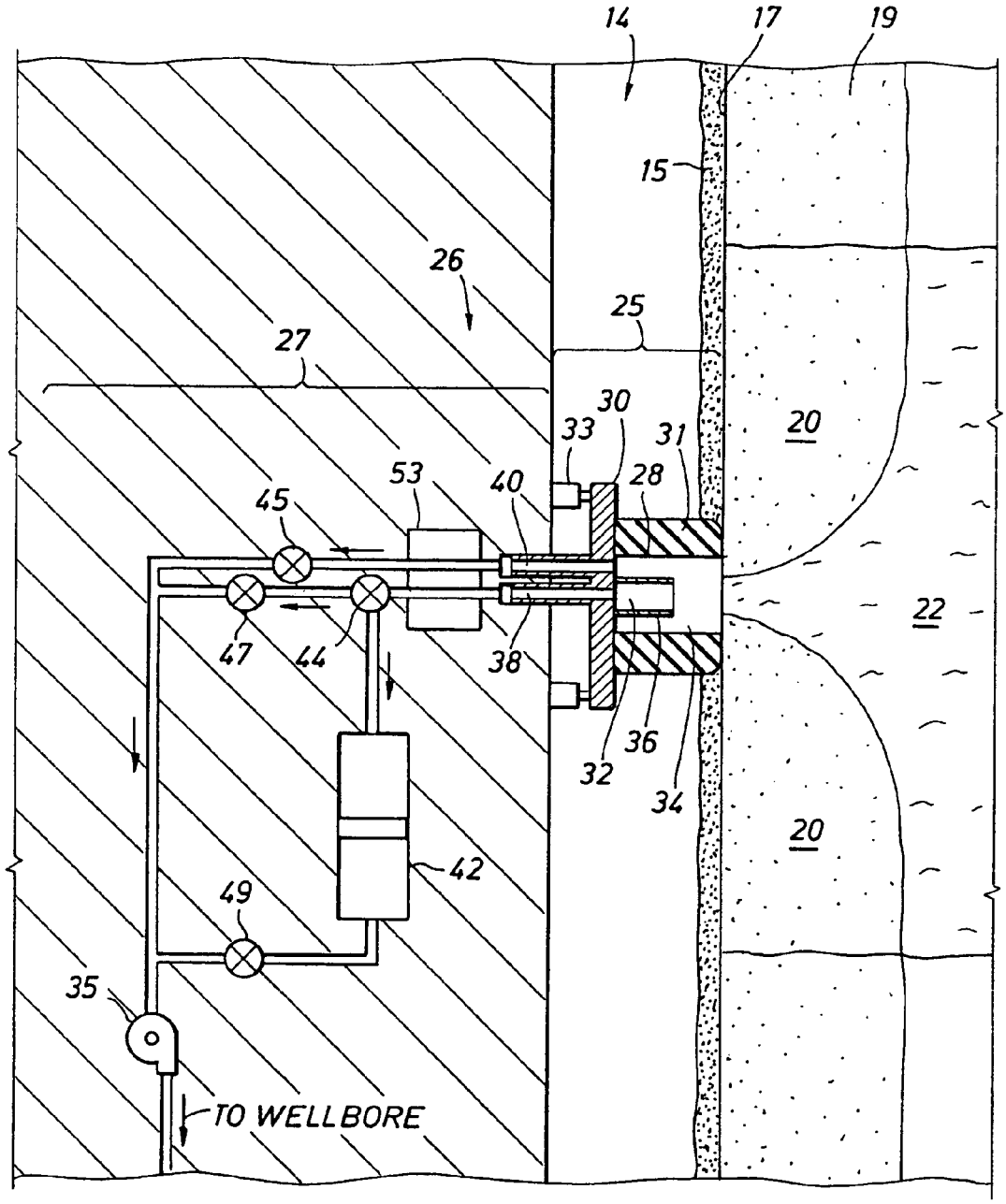
FIG. 5 is a detailed view of the fluid sampling device of FIG. 3 depicting an intake section and a fluid flow section.

Referring now to FIG. 5, the fluid sampling system 26 of FIG. 3 is shown in greater detail. The sampling system 26 includes an intake section 25 and a flow section 27 for selectively drawing fluid into the desired portion of the downhole tool.

The intake section 25 includes a probe 28 mounted on an extendable base 30 having a seal 31, such as a packer, for sealingly engaging the borehole wall 17 around the probe 28. The intake section 25 is selectively extendable from the downhole tool 10 via extension pistons 33. The probe 28 is provided with an interior channel 32 and an exterior channel 34 separated by wall 36. The wall 36 is preferably concentric with the probe 28. However, the geometry of the probe and the corresponding wall may be of any geometry. Additionally, one or more walls 36 may be used in various configurations within the probe.

The flow section 27 includes flow lines 38 and 40 driven by one or more pumps 35. A first flow line 38 is in fluid communication with the interior channel 32, and a second flow line 40 is in fluid communication with the exterior channel 34. The illustrated flow section may include one or more flow control devices, such as the pump 35 and valves 44, 45, 47 and 49 depicted in FIG. 5, for selectively drawing fluid into various portions of the flow section 27. Fluid is drawn from the formation through the interior and exterior channels and into their corresponding flow lines.

Preferably, contaminated fluid may be passed from the formation through exterior channel 34, into flow line 40 and discharged into the wellbore 14. Preferably, fluid passes from the formation into the interior channel 32, through flow line 38 and either diverted into one or more sample chambers 42, or discharged into the wellbore. Once it is determined that the fluid passing into flow line 38 is virgin fluid, a valve 44 and/or 49 may be activated using known control techniques by manual and/or automatic operation to divert fluid into the sample chamber.

The fluid sampling system 26 is also preferably provided with one or more fluid monitoring systems 53 for analyzing the fluid as it enters the probe 28. The fluid monitoring system 53 may be provided with various monitoring devices, such as optical fluid analyzers, as will be discussed more fully herein.

The details of the various arrangements and components of the fluid sampling system 26 described above as well as alternate arrangements and components for the system 26 would be known to persons skilled in the art and found in various other patents and printed publications, such as, those discussed herein. Moreover, the particular arrangement and components of the downhole fluid sampling system 26 may vary depending upon factors in each particular design, use or situation. Thus, neither the system 26 nor the present invention are limited to the above described arrangements and components and may include any suitable components and arrangement. For example, various flow lines, pump placement and valving may be adjusted to provide for a variety of configurations. Similarly, the arrangement and components of the downhole tool 10 may vary depending upon factors in each particular design, or use, situation. The above description of exemplary components and environments of the tool 10 with which the fluid sampling device 26 of the present invention may be used is provided for illustrative purposes only and is not limiting upon the present invention.

With continuing reference to FIG. 5, the flow pattern of fluid passing into the downhole tool 10 is illustrated. Initially, as shown in FIG. 1, an invaded zone 19 surrounds the borehole wall 17. Virgin fluid 22 is located in the formation 16 behind the invaded zone 19. At some time during the process, as fluid is extracted from the formation 16 into the probe 28, virgin fluid breaks through and enters the probe 28 as shown in FIG. 5. As the fluid flows into the probe, the contaminated fluid 22 in the invaded zone 19 near the interior channel 32 is eventually removed and gives way to the virgin fluid 22. Thus, only virgin fluid 22 is drawn into the interior channel 32, while the contaminated fluid 20 flows into the exterior channel 34 of the probe 28. To enable such result, the flow patterns, pressures and dimensions of the probe may be altered to achieve the desired flow path as will be described more fully herein.

Figure 6A:
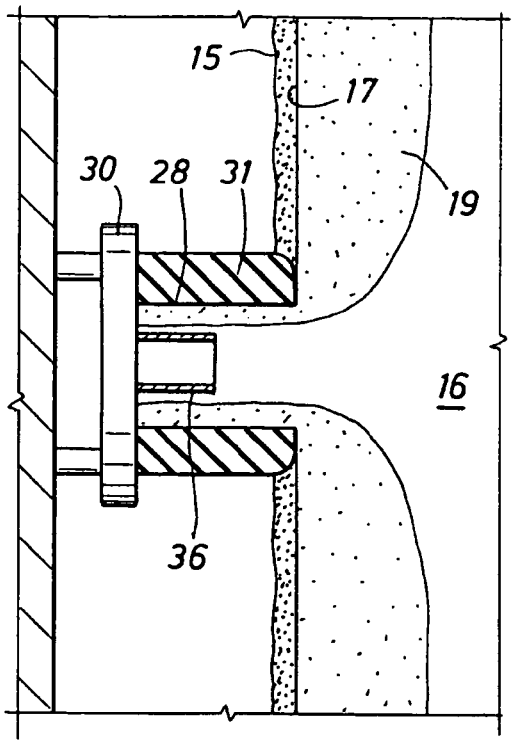
FIG. 6A is a detailed view of the intake section of FIG. 5 depicting the flow of fluid into a probe having a wall defining an interior channel, the wall recessed within the probe.

Referring now to FIGS. 6A-6J, various embodiments of the probe 28 are shown in greater detail. In FIG. 6A, the base 30 is shown supporting the seal 31 in sealing engagement with the borehole wall 17. The probe 28 preferably extends beyond the seal 31 and penetrates the mudcake 15. The probe 28 is placed in fluid communication with the formation 16.

The wall 36 is preferably recessed a distance within the probe 28. In this configuration, pressure along the formation wall is automatically equalized in the interior and exterior channels. The probe 28 and the wall 36 are preferably concentric circles, but may be of alternate geometries depending on the application or needs of the operation. Additional walls, channels and/or flow lines may be incorporated in various configurations to further optimize sampling.

Figure 6B:
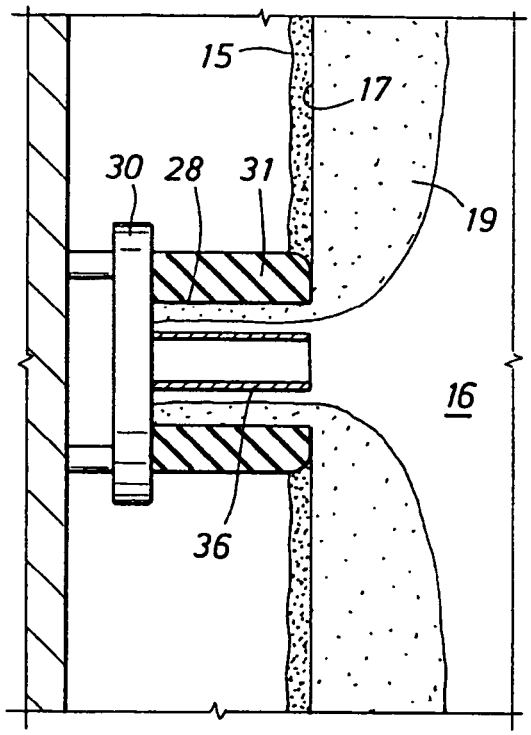
FIG. 6B is an alternate embodiment of the probe of FIG. 6A having a wall defining an interior channel, the wall flush with the probe.

The wall 36 is preferably adjustable to optimize the flow of virgin fluid into the probe. Because of varying flow conditions, it is desirable to adjust the position of the wall 36 so that the maximum amount of virgin fluid may be collected with the greatest efficiency. For example, the wall 36 may be moved or adjusted to various depths relative to the probe 28. As shown in FIG. 6B, the wall 36 may be positioned flush with the probe. In this configuration, the pressure in the interior channel along the formation may be different from the pressure in the exterior channel along the formation.

Figure 6C:
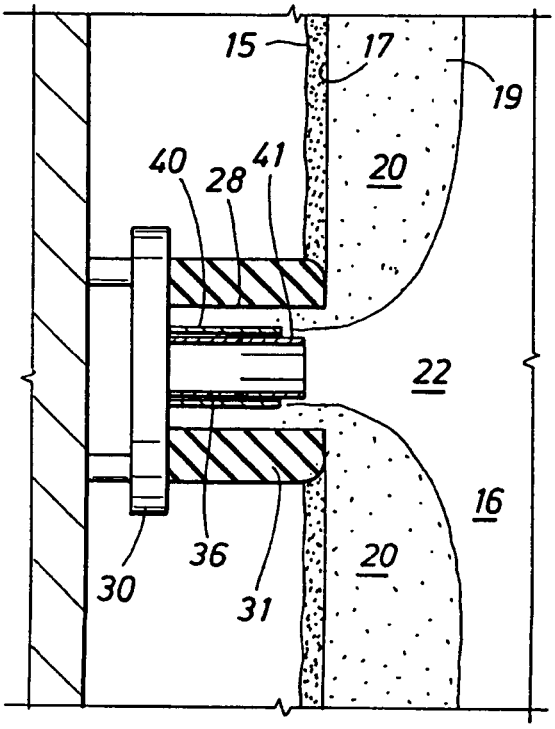
FIG. 6C is an alternate embodiment of the probe of FIG. 6A having a sizer capable of reducing the size of the interior channel.
Figure 6D:
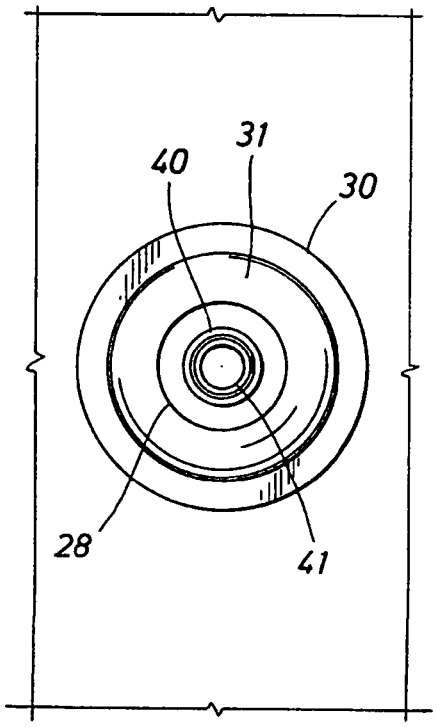
FIG. 6D is a cross-sectional view of the probe of FIG. 6C.
Figure 6E:
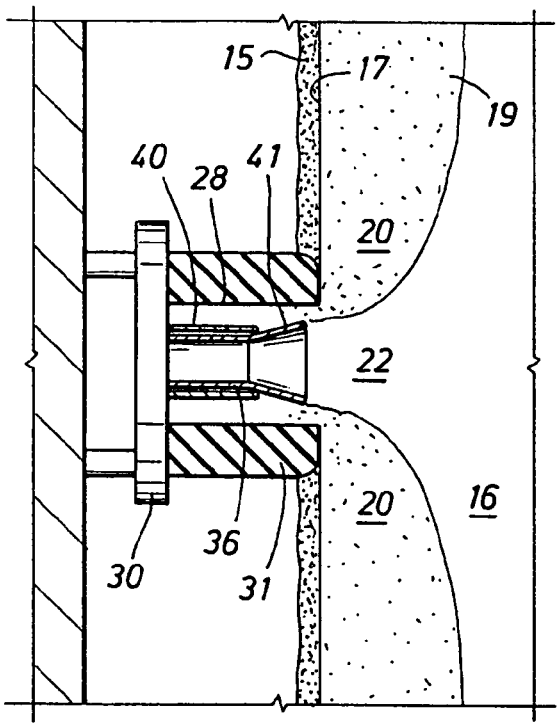
FIG. 6E is an alternate embodiment of the probe of FIG. 6A having a sizer capable of increasing the size of the interior channel.
Figure 6F:
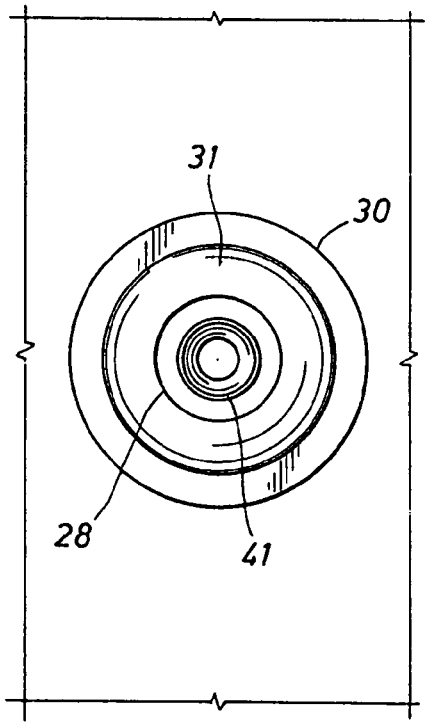
FIG. 6F is a cross-sectional view of the probe of FIG. 6E.

Referring now to FIGS. 6C-6H, the wall 36 is preferably capable of varying the size and/or orientation of the interior channel 32. As shown in FIG. 6C through 6F, the diameter of a portion or all of the wall 36 is preferably adjustable to align with the flow of contaminated fluid 20 from the invaded zone 19 and/or the virgin fluid 22 from the formation 16 into the probe 28. The wall 36 may be provided with a mouthpiece 41 and a guide 40 adapted to allow selective modification of the size and/or dimension of the interior channel. The mouthpiece 41 is selectively movable between an expanded and a collapsed position by moving the guide 40 along the wall 36. In FIGS. 6C and 6D, the guide 40 is surrounds the mouthpiece 41 and maintains it in the collapsed position to reduce the size of the interior flow channel in response to a narrower flow of virgin fluid 22. In FIGS. 6E and 6F, the guide 41 is retracted so that the mouthpiece 41 is expanded to increase the size of the interior flow channel in response to a wider flow of virgin fluid 22.

The mouthpiece depicted in FIGS. 6C-6F may be a folded metal spring, a cylindrical bellows, a metal energized elastomer, a seal, or any other device capable of functioning to selectively expand or extend the wall as desired. Other devices capable of expanding the cross-sectional area of the wall 36 may be envisioned. For example, an expandable spring cylinder pinned at one end may also be used.

Figure 6G:
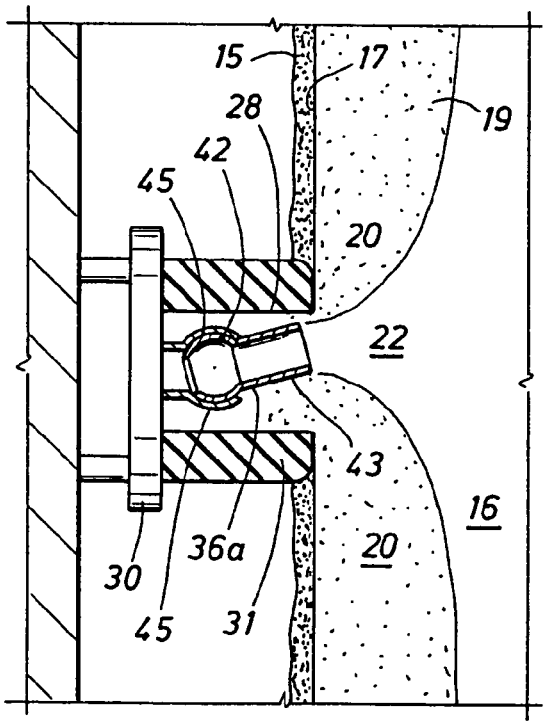
FIG. 6G is an alternate embodiment of the probe of FIG. 6A having a pivoter that adjusts the position of the interior channel within the probe.
Figure 6H:
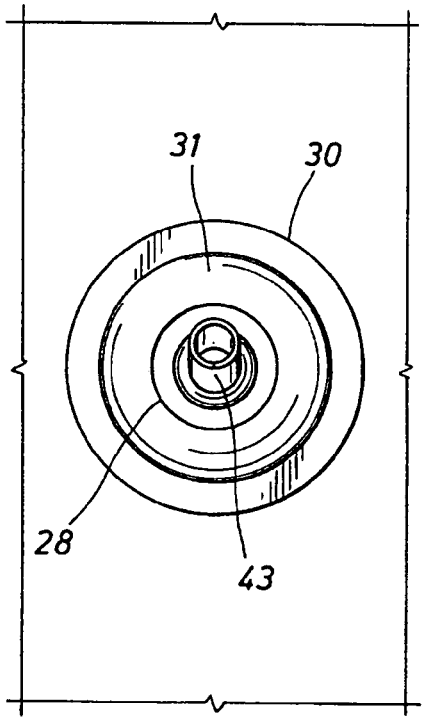
FIG. 6H is a cross-sectional view of the probe of FIG. 6G.

As shown in FIGS. 6G and 6H, the probe 28 may also be provided with a wall 36*a* having a first portion 42, a second portion 43 and a seal bearing 45 therebetween to allow selective adjustment of the orientation of the wall 36*a* within the probe. The second portion 43 is desirably movable within the probe 28 to locate an optimal alignment with the flow of virgin fluid 20.

Figure 6I:
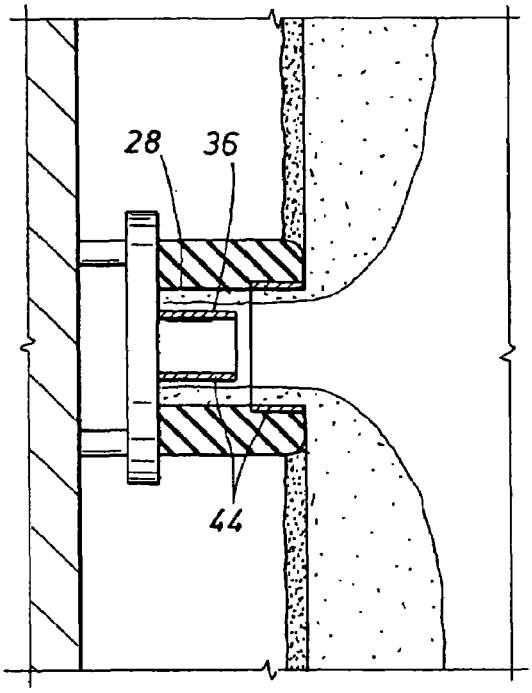
FIG. 6I is an alternate embodiment of the probe of FIG. 6A having a shaper that adjusts the shape of the probe and/or interior channel.
Figure 6J:
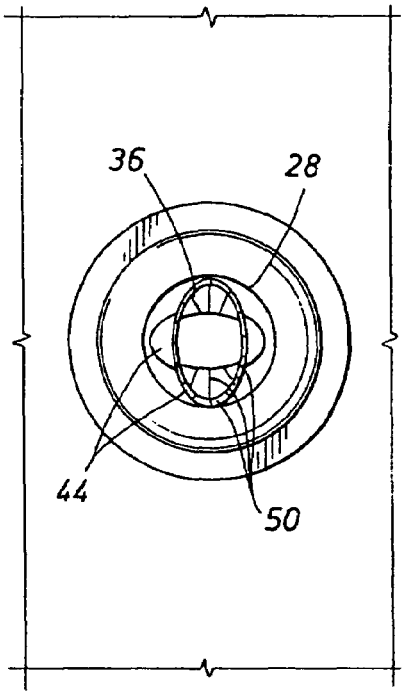
FIG. 6J is a cross-sectional view of the probe of FIG. 6I.

Additionally, as shown in FIGS. 6I and 6J, one or more shapers 44 may also be provided to conform the probe 28 and/or wall 36 into a desired shape. The shapers 44 have two more fingers 50 adapted to apply force to various positions about the probe and/or wall 36 causing the shape to deform. When the probe 40 and or wall 36 are extended as depicted in FIG. 6E, the shaper 44 may be extended about at least a portion of the mouthpiece 41 to selectively deform the mouthpiece to the desired shape. If desired, the shapers apply pressure to various positions around the probe and/or wall to generate the desired shape.

The sizer, pivoter and/or shaper may be any electronic mechanism capable of selectively moving the wall 36 as provided herein. One or more devices may be used to perform one or more of the adjustments. Such devices may include a selectively controllable slidable collar, a pleated tube, or cylindrical bellows or spring, an elastomeric ring with embedded spring-biased metal fingers, a flared elastomeric tube, a spring cylinder, and/or any suitable components with any suitable capabilities and operation may be used to provide any desired variability.

These and other adjustment devices may be used to alter the channels for fluid flow. Thus, a variety of configurations may be generated by combining one or more of the adjustable features.

Figure 7A:
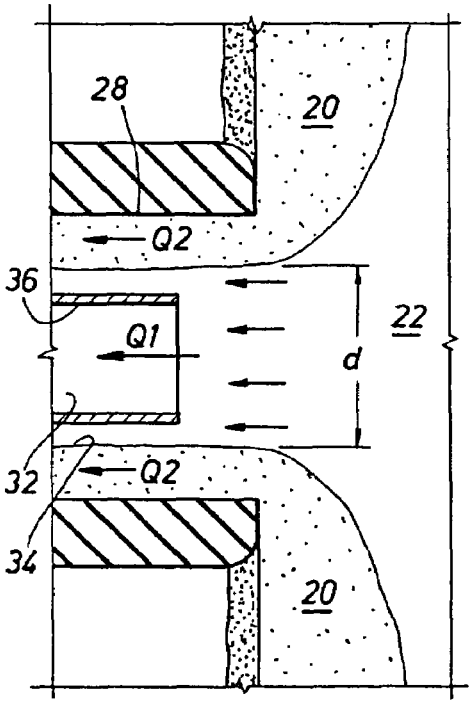
FIG. 7A is a schematic view of the probe of FIG. 6A with the flow of fluid from the formation into the probe with the pressure and/or flow rate balanced between the interior and exterior flow channels for substantially linear flow into the probe.
Figure 7B:
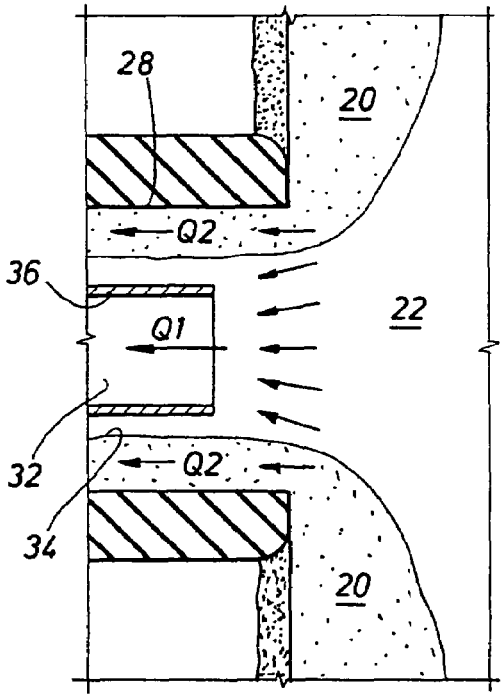
FIG. 7B is a schematic view of the probe of FIG. 7A with the flow rate of the interior channel greater than the flow rate of the exterior channel.

Now referring to FIGS. 7A and 7B, the flow characteristics are shown in greater detail. Various flow characteristics of the probe 28 may be adjusted. For example, as shown in FIG. 7A, the probe 28 may be designed to allow controlled flow separation of virgin fluid 22 into the interior channel 32 and contaminated fluid 20 into the exterior channel 34. This may be desirable, for example, to assist in minimizing the sampling time required before acceptable virgin fluid is flowing into the interior channel 32 and/or to optimize or increase the quantity of virgin fluid flowing into the interior channel 32, or other reasons.

The ratio of fluid flow rates within the interior channel 32 and the exterior channel 34 may be varied to optimize, or increase, the volume of virgin fluid drawn into the interior channel 32 as the amount of contaminated fluid 20 and/or virgin fluid 22 changes over time. The diameter d of the area of virgin fluid flowing into the probe may increase or decrease depending on wellbore and/or formation conditions. Where the diameter d expands, it is desirable to increase the amount of flow into the interior channel. This may be done by altering the wall 36 as previously described. Alternatively or simultaneously, the flow rates to the respective channels may be altered to further increase the flow of virgin fluid into the interior channel.

The comparative flow rate into the channels 32 and 34 of the probe 28 may be represented by a ratio of flow rates $Q_1/Q_2$. The flow rate into the interior channel 32 is represented by $Q_1$ and the flow rate in the exterior channel 34 is represented by $Q_2$. The flow rate $Q_1$ in the interior channel 32 may be selectively increased and/or the flow rate $Q_2$ in the exterior channel 34 may be decreased to allow more fluid to be drawn into the interior channel 32. Alternatively, the flow rate $Q_1$ in the interior channel 32 may be selectively decreased and/or the flow rate ($Q_2$) in the exterior channel 34 may be increased to allow less fluid to be drawn into the interior channel 32.

As shown in FIG. 7A, $Q_1$ and $Q_2$ represent the flow of fluid through the probe 28. The flow of fluid into the interior channel 32 may be altered by increasing or decreasing the flow rate to the interior channel 32 and/or the exterior channel 34. For example, as shown in FIG. 7B, the flow of fluid into the interior channel 32 may be increased by increasing the flow rate $Q_1$ through the interior channel 32, and/or by decreasing the flow rate $Q_2$ through the exterior channel 34. As indicated by the arrows, the change in the ratio $Q_1/Q_2$ steers a greater amount of the fluid into the interior channel 32 and increases the amount of virgin fluid drawn into the downhole tool (FIG. 5).

The flow rates within the channels 32 and 34 may be selectively controllable in any desirable manner and with any suitable component(s). For example, one or more flow control device 35 is in fluid communication with each flowline 38, 40 may be activated to adjust the flow of fluid into the respective channels (FIG. 5). The flow control 35 and valves 45, 47 and 49 of this example can, if desired, be actuated on a real-time basis to modify the flow rates in the channels 32 and 34 during production and sampling.

The flow rate may be altered to affect the flow of fluid and optimize the intake of virgin fluid into the downhole tool. Various devices may be used to measure and adjust the rates to optimize the fluid flow into the tool. Initially, it may be desirable to have increased flow into the exterior channel when the amount of contaminated fluid is high, and then adjust the flow rate to increase the flow into the interior channel once the amount of virgin fluid entering the probe increases. In this manner, the fluid sampling may be manipulated to increase the efficiency of the sampling process and the quality of the sample.

Figure 8B:
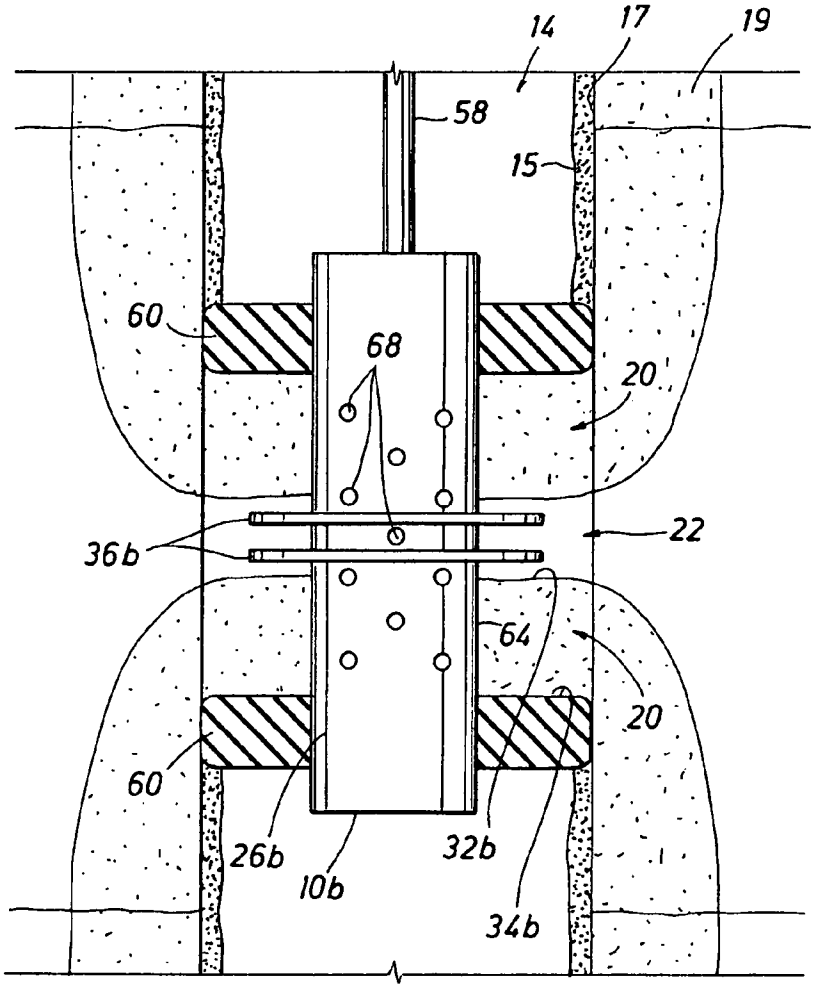
FIG. 8B is a schematic view of the downhole tool of FIG. 8A with the walls moved together in response to changes in the fluid flow.
Figure 8A:
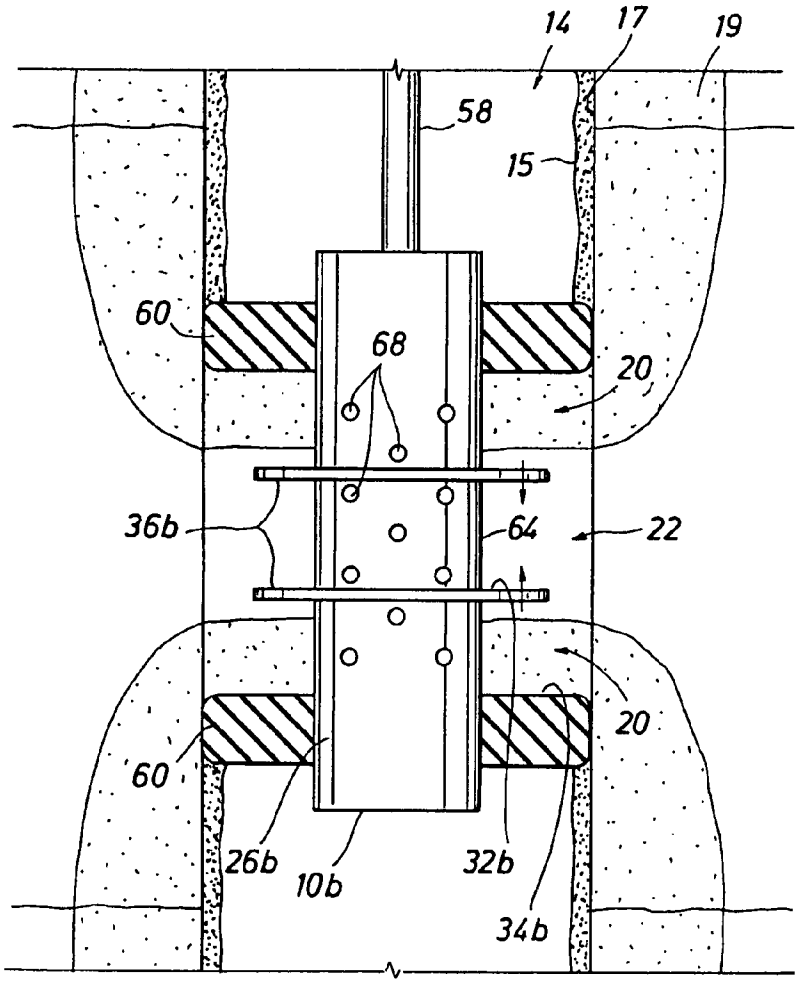
FIG. 8A is a schematic view of an alternate embodiment of the downhole tool and fluid flowing system having dual packers and walls.

Referring now to FIGS. 8A and 8B, another embodiment of the present invention employing a fluid sampling system 26*b* is depicted. A downhole tool 10*b* is deployed into wellbore 14 on coiled tubing 58. Dual packers 60 extend from the downhole tool 10*b* and sealingly engage the sidewall 17 of the wellbore 14. The wellbore 14 is lined with mud cake 15 and surrounded by an invaded zone 19. A pair of cylindrical walls or rings 36*b* are preferably positioned between the packers 60 for isolation from the remainder of the wellbore 14. The packers 60 may be any device capable of sealing the probe from exposure to the wellbore, such as packers or any other suitable device.

The walls 36*b* are capable of separating fluid extracted from the formation 16 into at least two flow channels 32*b* and 34*b*. The tool 10*b* includes a body 64 having at least one fluid inlet 68 in fluid communication with fluid in the wellbore between the packers 60. The walls 36*b* are positioned about the body 64. As indicated by the arrows, the walls 36*b* are axially movable along the tool. Inlets positioned between the walls 36 preferably capture virgin fluid 22, while inlets outside the walls 36 preferably draw in contaminated fluid 20.

The walls 36*b* are desirably adjustable to optimize the sampling process. The shape and orientation of the walls 36*b* may be selectively varied to alter the sampling region. The distance between the walls 36*b* and the borehole wall 17, may be varied, such as by selectively extending and retracting the walls 36*b* from the body 64. The position of the walls 36*b* may be along the body 64. The position of the walls along the body 64 may to moved apart to increase the number of intakes 68 receiving virgin fluid, or moved together to reduce the number of intakes receiving virgin fluid depending on the flow characteristics of the formation. The walls 36*b* may also be centered about a given position along the tool 10*b* and/or a portion of the borehole 14 to align certain intakes 68 with the flow of virgin fluid 22 into the wellbore 14 between the packers 60.

The position of the movement of the walls along the body may or may not cause the walls to pass over intakes. In some embodiments, the intakes may be positioned in specific regions about the body. In this case, movement of the walls along the body may redirect flow within a given area between the packers without having to pass over intakes. The size of the sampling region between the walls 36*b* may be selectively adjusted between any number of desirable positions, or within any desirable range, with the use of any suitable component(s) and technique(s).

An example of a flow system for selectively drawing fluid into the downhole tool is depicted in FIG. 8C. A fluid flow line 70 extends from each intake 68 into the downhole tool 10*b* and has a corresponding valve 72 for selectively diverting fluid to either a sample chamber 75 or into the wellbore outside of the packers 60. One or more pumps 35 may be used in coordination with the valves 72 to selectively draw fluid in at various rates to control the flow of fluid into the downhole tool. Contaminated fluid is preferably dispersed back to the wellbore. However, where it is determined that virgin fluid is entering a given intake, a valve 72 corresponding to the intake may be activated to deliver the virgin fluid to a sample chamber 75. Various measurement devices, such as an OFA 59 may be used to evaluate the fluid drawn into the tool. Where multiple intakes are used, specific intakes may be activated to increase the flow nearest the central flow of virgin fluid, while intakes closer to the contaminated region may be decreased to effectively steer the highest concentration of virgin fluid into the downhole tool for sampling.

One or more probes 28 as depicted in any of FIGS. 3-6J may also be used in combination with the probe 28*b* of FIG. 8A or 8B.

Figure 9:
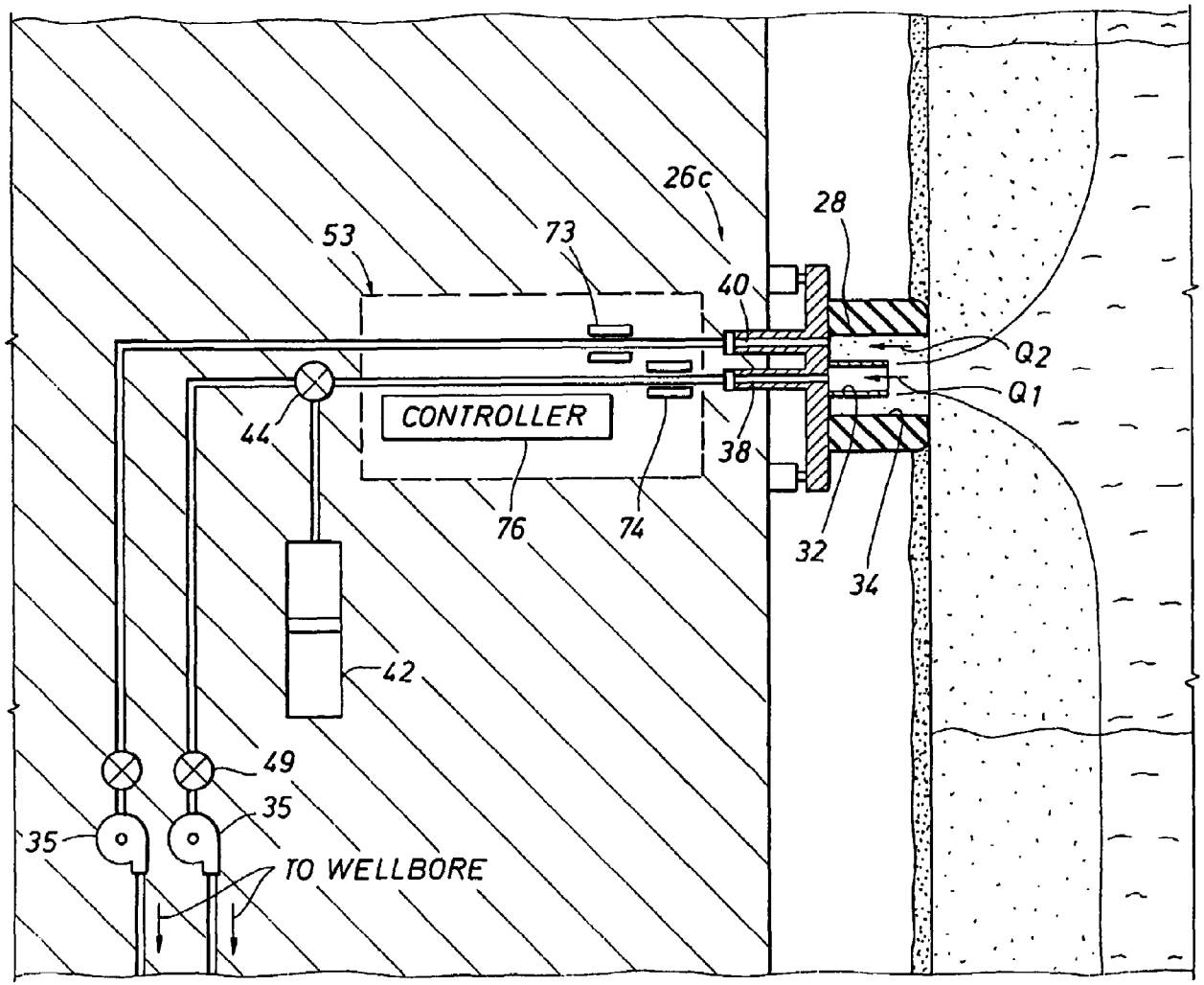
FIG. 9 is a schematic view of the fluid sampling device of FIG. 5 having flow lines with individual pumps.

Referring to FIG. 9, another view of the fluid sampling system 26 of FIG. 5 is shown. In FIG. 9, the flow lines 38 and 40 each have a pump 35 for selectively drawing fluid into the channels 32 and 34 of the probe 28.

The fluid monitoring system 53 of FIG. 5 is shown in greater detail in FIG. 9. The flow lines 38 and 40 each pass through the fluid monitoring system 53 for analysis therein. The fluid monitoring system 53 is provided with an optical fluid analyzer 73 for measuring optical density in flow line 40 and an optical fluid analyzer 74 for measuring optical density in flow line 38. The optical fluid analyzer may be a device such as the analyzer described in U.S. Pat. No. 6,178,815 to Felling et al. and/or U.S. Pat. No. 4,994,671 to Safinya et al., both of which are hereby incorporated by reference.

While the fluid monitoring system 53 of FIG. 9 is depicted as having an optical fluid analyzer for monitoring the fluid, it will be appreciated that other fluid monitoring devices, such as gauges, meters, sensors and/or other measurement or equipment incorporating for evaluation, may be used for determining various properties of the fluid, such as temperature, pressure, composition, contamination and/or other parameters known by those of skill in the art.

A controller 76 is preferably provided to take information from the optical fluid analyzer(s) and send signals in response thereto to alter the flow of fluid into the interior channel 32 and/or exterior channel 34 of the probe 28. As depicted in FIG. 9, the controller is part of the fluid monitoring system 53; however, it will be appreciated by one of skill in the art that the controller may be located in other parts of the downhole tool and/or surface system for operating various components within the wellbore system.

The controller is capable of performing various operations throughout the wellbore system. For example, the controller is capable of activating various devices within the downhole tool, such as selectively activating the sizer, pivoter, shaper and/or other probe device for altering the flow of fluid into the interior and/or exterior channels 32, 34 of the probe. The controller may be used for selectively activating the pumps 35 and/or valves 44, 45, 47, 49 for controlling the flow rate into the channels 32, 34, selectively activating the pumps 35 and/or valves 44, 45, 47, 49 to draw fluid into the sample chamber(s) and/or discharge fluid into the wellbore, to collect and/or transmit data for analysis uphole and other functions to assist operation of the sampling process. The controller may also be used for controlling fluid extracted from the formation, providing accurate contamination parameter values useful in a contamination monitoring model, adding certainty in determining when extracted fluid is virgin fluid sufficient for sampling, enabling the collection of improved quality fluid for sampling, reducing the time required to achieve any of the above, or any combination thereof. However, the contamination monitoring calibration capability can be used for any other suitable purpose(s). Moreover, the use(s) of, or reasons for using, a contamination monitoring calibration capability are not limiting upon the present invention.

An example of optical density (OD) signatures generated by the optical fluid analyzers 72 and 74 of FIG. 9 is shown in FIG. 10. FIG. 10 shows the relationship between OD and the total volume V of fluid as it passes into the interior and exterior channels of the probe. The OD of the fluid flowing through the interior channel 32 is depicted by line 80. The OD of the fluid flowing through the exterior channel 34 is depicted as line 82. The resulting signatures represented by lines 80 and 82 may be used to calibrate future measurements.

Initially, the OD of fluid flowing into the channels is at $OD_{mf}$. $OD_{mf}$ represents the OD of the contaminated fluid adjacent the wellbore as depicted in FIG. 1. Once the volume of fluid entering the interior channel reaches $V_1$, virgin fluid breaks through. The OD of the fluid entering into the channels increases as the amount of virgin fluid entering into the channels increases. As virgin fluid enters the interior channel 32, the OD of the fluid entering into the interior channel increases until it reaches a second plateau at $V_2$ represented by $OD_{vf}$. While virgin fluid also enters the exterior channel 34, most of the contaminated fluid also continues to enter the exterior channel. The OD of fluid in the exterior channel as represented by line 82, therefore, increases, but typically does not reach the $OD_{vf}$ due to the presence of contaminants. The breakthrough of virgin fluid and flow of fluid into the interior and exterior channels is previously described in relation to FIG. 2.

The distinctive signature of the OD in the internal channel may be used to calibrate the monitoring system or its device. For example, the parameter $OD_{vf}$, which characterizes the optical density of virgin fluid can be determined. This parameter can be used as a reference for contamination monitoring. The data generated from the fluid monitoring system may then be used for analytical purposes and as a basis for decision making during the sampling process.

By monitoring the coloration generated at various optical channels of the fluid monitoring system 53 relative to the curve 80, one can determine which optical channel(s) provide the optimum contrast readout for the optical densities $OD_{mf}$ and $OD_{vf}$. These optical channels may then be selected for contamination monitoring purposes.

FIGS. 11A and 11B depict the relationship between the OD and flow rate of fluid into the probe. FIG. 11A shows the OD signatures of FIG. 10 that has been adjusted during sampling. As in FIG. 10, line 80 shows the signature of the OD of the fluid entering the interior channel 32, and 82 shows the signature of the OD of the fluid entering the exterior channel 34. However, FIG. 11A further depicts evolution of the OD at volumes $V_3$, $V_4$ and $V_5$ during the sampling process.

FIG. 11B shows the relationship between the ratio of flow rates $Q_1/Q_2$ to the volume of fluid that enters the probe. As depicted in FIG. 7A, $Q_1$ relates to the flow rate into the interior channel 32, and $Q_2$ relates to the flow rate into the exterior channel 34 of the probe 28. Initially, as mathematically depicted by line 84 of FIG. 11B, the ratio of flow $Q_1/Q_2$ is at a given level $(Q_1/Q_2)_i$ corresponding to the flow ratio of FIG. 7A. However, the ratio $Q_1/Q_2$ can then be gradually increased, as described with respect to FIG. 7B, so that the ratio of $Q_1/Q_2$ increases. This gradual increase in flow ratio is mathematically depicted as the line 84 increases to the level $(Q_1/Q_2)_n$ at a given volume, such as $V_4$. As depicted in FIG. 11B, the ratio can be further increased up to $V_5$.

As the ratio of flow rate increases, the corresponding OD of the interior channel 32 represented by lines 80 shifts to deviation 81, and the OD of the exterior channel 34 represented by line 82 shifts to deviations 83 and 85. The shifts in the ratio of flow depicted in FIG. 11B correspond to shifts in the OD depicted in FIG. 11A for volumes $V_1$ through $V_5$. An increase in the flow rate ratio at $V_3$ (FIG. 11B) shifts the OD of the fluid flowing into the exterior channel from its expected path 82 to a deviation 83 (FIG. 11B). A further increase in ratio as depicted by line 84 at $V_4$ (FIG. 11A), causes a shift in the OD of line 80 from its reference level $OD_{vf}$ to a deviation 81 (FIG. 11B). The deviation of the OD of line 81 at $V_4$, causes the OD of line 80 to return to its reference level $OD_{vf}$ at $V_5$, while the OD of deviation 83 drops further along deviation 85. Further adjustments to OD and/or ratio may be made to alter the flow characteristics of the sampling process.

Figure 12:
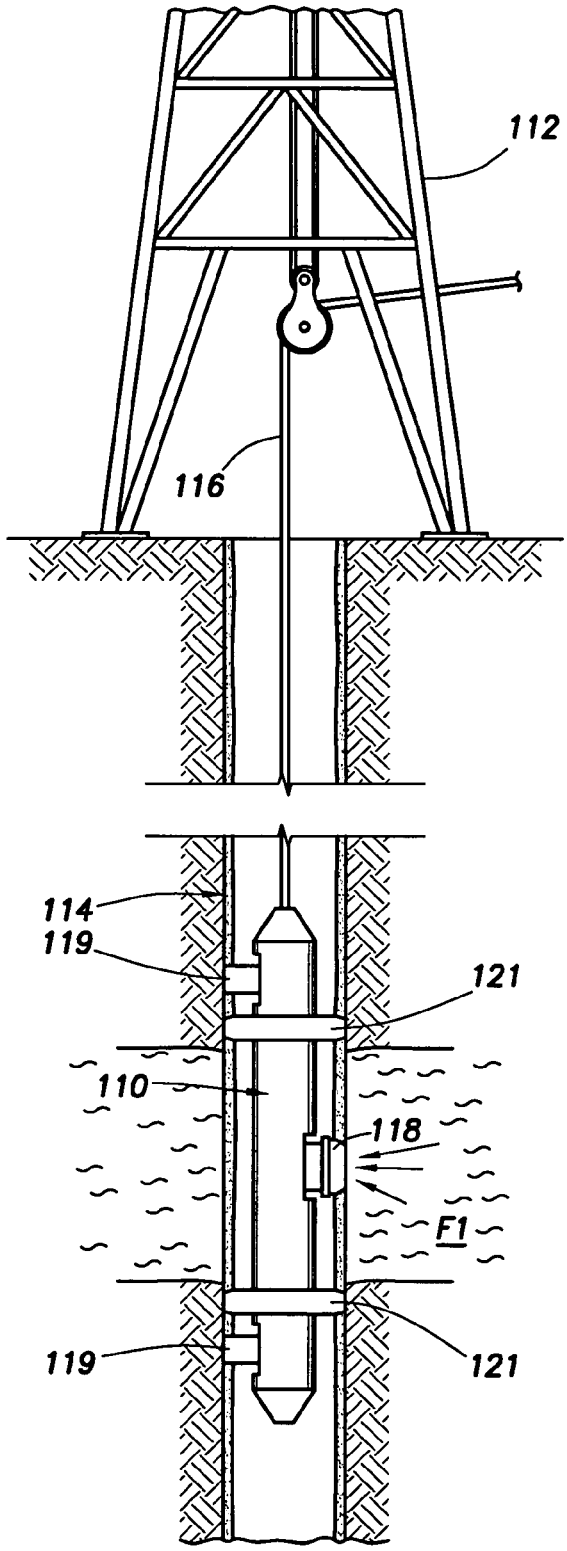
FIG. 12 (PRIOR ART)
FIG. 12 is a schematic view, partially in cross-section of downhole formation evaluation tool positioned in a wellbore adjacent a subterranean formation.

FIG. 12 depicts another a conventional wireline tool 110 with a probe 118 and fluid flow system. In FIG. 12, the tool 110 is deployed from a rig 112 into a wellbore 114 via a wireline cable 116 and positioned adjacent a formation F1. The downhole tool 110 is provided with a probe 118 adapted to seal with the wellbore wall and draw fluid from the formation into the downhole tool. Dual packers 121 are also depicted to demonstrate that various fluid communication devices, such as probes and/or packers, may be used to draw fluid into the downhole tool. Backup pistons 119 assist in pushing the downhole tool and probe against the wellbore wall.

Figure 13:
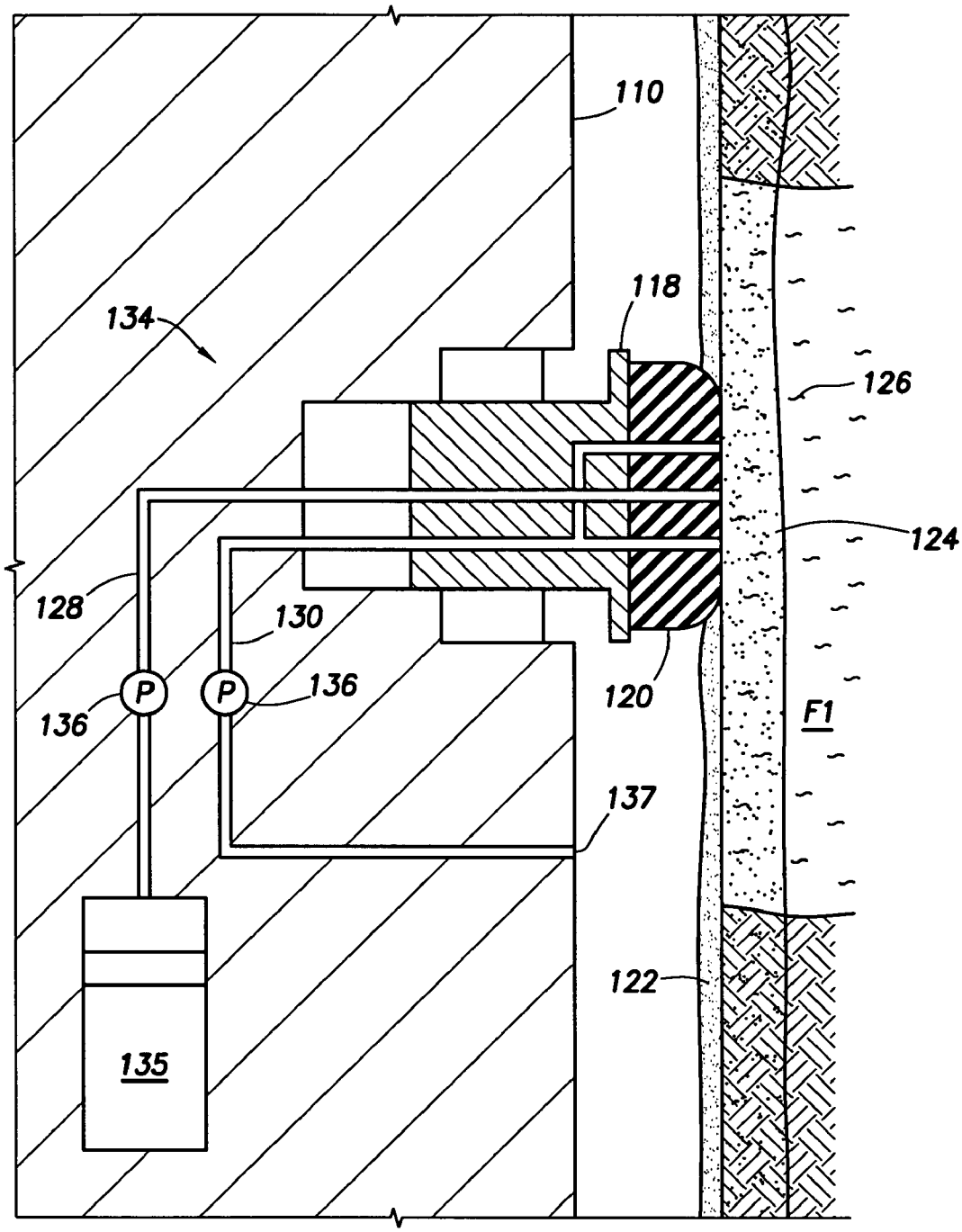
FIG. 13 is a schematic view of a portion of a downhole formation evaluation tool depicting a fluid flow system for receiving fluid from the adjacent formation.

FIG. 13 is a schematic view of a portion of the downhole tool depicting a fluid flow system 134. This portion may be usable in a downhole tool similar to the one shown in FIG. 12. The probe 118 is preferably extended from the downhole tool for engagement with the wellbore wall. The probe is provided with a packer 120 for sealing with the wellbore wall. The packer contacts the wellbore wall and forms a seal with the mudcake 122 lining the wellbore. The mudcake seeps into the wellbore wall and creates an invaded zone 124 about the wellbore. The invaded zone contains mud and other wellbore fluids that contaminate the surrounding formations, including the formation F1 and a portion of the clean formation fluid 126 contained therein.

Figure 2:
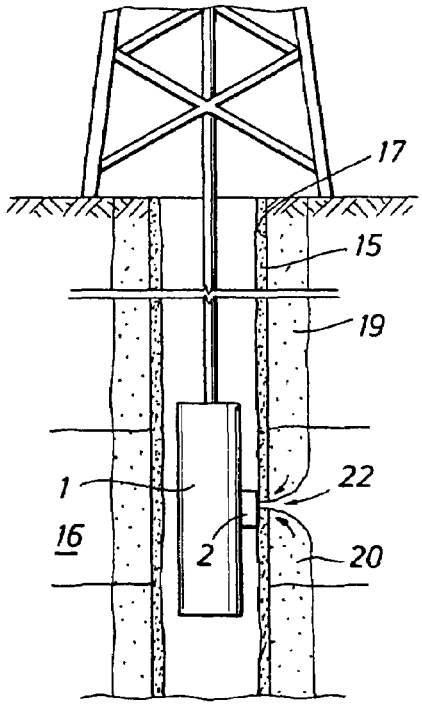
FIG. 2 (PRIOR ART)
FIG. 2 is a schematic view of a down hole tool positioned in the wellbore with a probe extending to the formation, depicting the flow of contaminated and virgin fluid into a downhole sampling tool.

The probe 118 is preferably provided with at least two flowlines, an evaluation flowline 128 and a cleanup flowline 130. It will be appreciated that in cases where dual packers are used, inlets may be provided therebetween to draw fluid into the evaluation and cleanup flowlines in the downhole tool. Examples of fluid communication devices, such as probes and dual packers, used for drawing fluid into separate flowlines are depicted in FIGS. 1, 2 and 9 above and in U.S. Pat. No. 6,719,049, assigned to the assignee of the present invention, and U.S. Pat. No. 6,301,959 assigned to Halliburton.

The evaluation flowline extends into the downhole tool and is used to pass clean formation fluid into the downhole tool for testing and/or sampling. The evaluation flowline extends to a sample chamber 135 for collecting samples of formation fluid. The cleanup flowline 130 extends into the downhole tool and is used to draw contaminated fluid away from the clean fluid flowing into the evaluation flowline. Contaminated fluid may be dumped into the wellbore through an exit port 137. One or more pumps 136 may be used to draw fluid through the flowlines. A divider or barrier is preferably positioned between the evaluation and cleanup flowlines to separate the fluid flowing therein.

Figure 14:
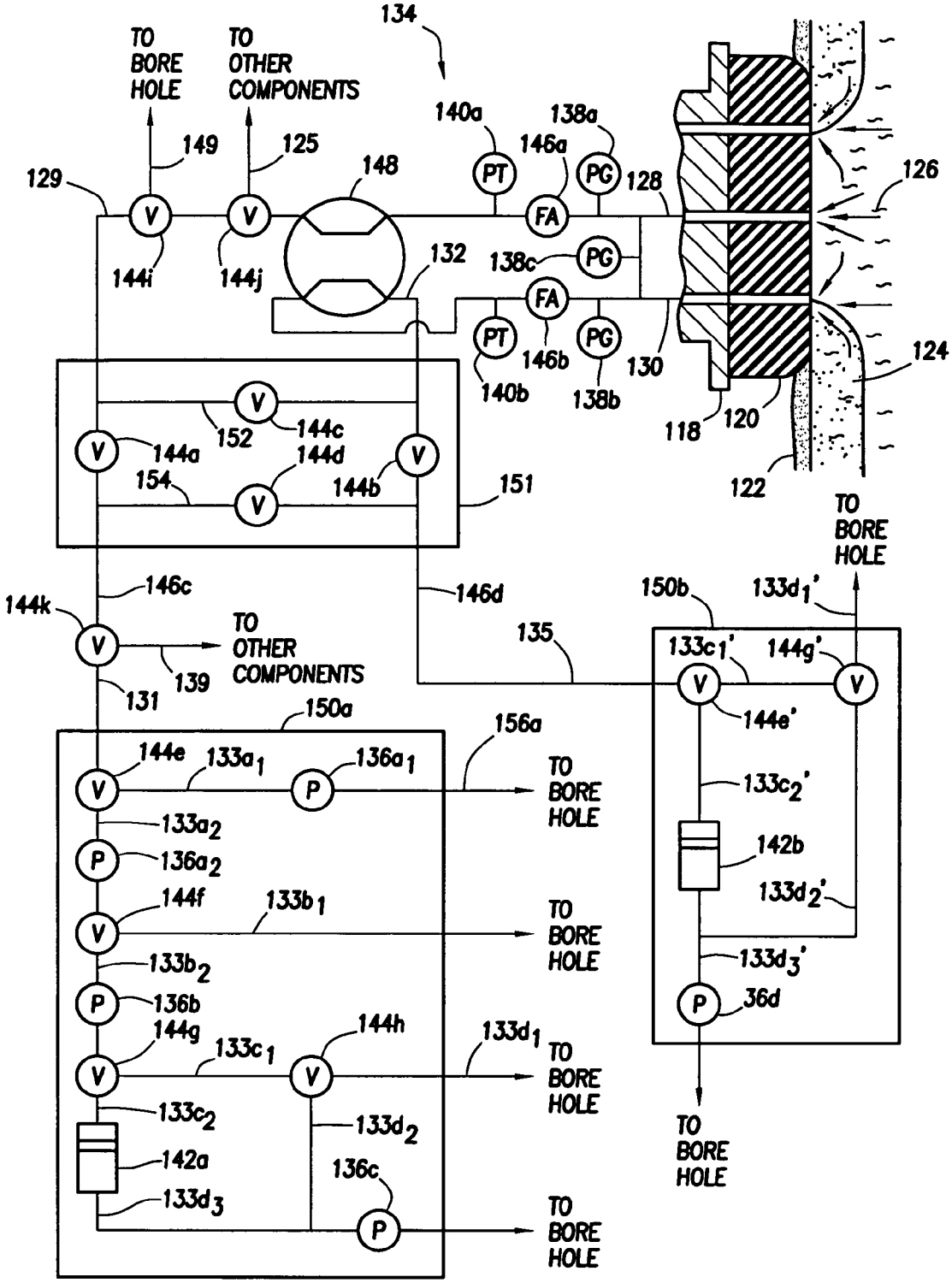
FIG. 14 is a schematic, detailed view of the downhole tool and fluid flow system of FIG. 13.

Referring now to FIG. 14, the fluid flow system 134 of FIG. 13 is shown in greater detail. In this figure, fluid is drawn into the evaluation and cleanup flowlines through probe 118. As fluid flows into the tool, the contaminated fluid in the invaded zone 124 (FIG. 13) breaks through so that the clean fluid 126 may enter the evaluation flowline 128 (FIG. 14). Contaminated fluid is drawn into the cleanup line and away from the evaluation flowline as shown by the arrows. FIG. 14 depicts the probe as having a cleanup flowline that forms a ring about the surface of the probe. However, it will be appreciated that other layouts of one or more intake and flowlines extending through the probe may be used.

The evaluation and cleanup flowlines 128, 130 extend from the probe 118 and through the fluid flow system 134 of the downhole tool. The evaluation and cleanup flowlines are in selective fluid communication with flowlines extending through the fluid flow system as described further herein. The fluid flow system of FIG. 14 includes a variety of features for manipulating the flow of clean and/or contaminated fluid as it passes from an upstream location near the formation to a downstream location through the downhole tool. The system is provided with a variety of fluid measuring and/or manipulation devices, such as flowlines (128, 129, 130, 131, 132, 133, 135), pumps 136, pretest pistons 140, sample chambers 142, valves 144, fluid connectors (148, 151) and sensors (138, 146). The system may also provided with a variety of additional devices, such as restrictors, diverters, processors and other devices for manipulating flow and/or performing various formation evaluation operations.

Evaluation flowline 128 extends from probe 118 and fluidly connects to flowlines extending through the downhole tool. Evaluation flowline 128 is preferably provided with a pretest piston 140*a* and sensors, such as pressure gauge 138*a* and a fluid analyzer 146*a*. Cleanup flowline 130 extends from probe 118 and fluidly connects to flowlines extending through the downhole tool. Cleanup flowline 130 is preferably provided with a pretest piston 140*b* and sensors, such as a pressure gauge 138*b* and a fluid analyzer 146*b*. Sensors, such as pressure gauge 138*c*, may be connected to evaluation and cleanup flowlines 128 and 130 to measure parameters therebetween, such as differential pressure. Such sensors may be located in other positions along any of the flowlines of the fluid flow system as desired.

One or more pretest piston may be provided to draw fluid into the tool and perform a pretest operation. Pretests are typically performed to generate a pressure trace of the drawdown and buildup pressure in the flowline as fluid is drawn into the downhole tool through the probe. When used in combination with a probe having an evaluation and cleanup flowline, the pretest piston may be positioned along each flowline to generate curves of the formation. These curves may be compared and analyzed. Additionally, the pretest pistons may be used to draw fluid into the tool to break up the mudcake along the wellbore wall. The pistons may be cycled synchronously, or at disparate rates to align and/or create pressure differentials across the respective flowlines.

The pretest pistons may also be used to diagnose and/or detect problems during operation. Where the pistons are cycled at different rates, the integrity of isolation between the lines may be determined. Where the change in pressure across one flowline is reflected in a second flowline, there may be an indication that insufficient isolation exists between the flowlines. A lack of isolation between the flowlines may indicate that an insufficient seal exists between the flowlines. The pressure readings across the flowlines during the cycling of the pistons may be used to assist in diagnosis of any problems, or verification of sufficient operability.

The fluid flow system may be provided with fluid connectors, such as crossover 148 and/or junction 151, for passing fluid between the evaluation and cleanup flowlines (and/or flowlines fluidly connected thereto). These devices may be positioned at various locations along the fluid flow system to divert the flow of fluid from one or more flowlines to desired components or portions of the downhole tool. As shown in FIG. 14, a rotatable crossover 148 may be used to fluidly connect evaluation flowline 128 with flowline 132, and cleanup flowline 130 with flowline 129. In other words, fluid from the flowlines may selectively be diverted between various flowlines as desired. By way of example, fluid may be diverted from flowline 128 to flow circuit 150*b*, and fluid may be diverted from flowline 130 to flow circuit 150*a*.

Junction 151 is depicted in FIG. 14 as containing a series of valves 144*a, b, c, d* and associated connector flowlines 152 and 154. Valve 144*a* permits fluid to pass from flowline 129 to connector flowline 154 and/or through flowline 131 to flow circuit 150*a*. Valve 144*b* permits fluid to pass from flowline 132 to connector flowline 154 and/or through flowline 135 to flow circuit 150*b*. Valve 144*c* permits fluid to flow between flowlines 129, 132 upstream of valves 144*a* and 144*b*. Valve 144*d* permits fluid to flow between flowlines 131, 135 downstream of valves 144*a* and 144*b*. This configuration permits the selective mixing of fluid between the evaluation and cleanup flowlines. This may be used, for example, to selectively pass fluid from the flowlines to one or both of the sampling circuits 150*a, b*.

Valves 144*a* and 144*b* may also be used as isolation valves to isolate fluid in flowline 129, 132 from the remainder of the fluid flow system located downstream of valves 144*a, b*. The isolation valves are closed to isolate a fixed volume of fluid within the downhole tool (i.e. in the flowlines between the formation and the valves 144*a, b*). The fixed volume located upstream of valve 144*a* and/or 144*b* is used for performing downhole measurements, such as pressure and mobility.

In some cases, it is desirable to maintain separation between the evaluation and cleanup flowlines, for example during sampling. This may be accomplished, for example, by closing valves 144*c* and/or 144*d* to prevent fluid from passing between flowlines 129 and 132, or 131 and 135. In other cases, fluid communication between the flowlines may be desirable for performing downhole measurements, such as formation pressure and/or mobility estimations. This may be accomplished for example by closing valves 144*a, b*, opening valves 144*c* and/or 144*d* to allow fluid to flow across flowlines 129 and 132 or 131 and 135, respectively. As fluid flows into the flowlines, the pressure gauges positioned along the flowlines can be used to measure pressure and determine the change in volume and flow area at the interface between the probe and formation wall. This information may be used to generate the formation mobility.

Valves 144*c, d* may also be used to permit fluid to pass between the flowlines inside the downhole tool to prevent a pressure differential between the flowlines. Absent such a valve, pressure differentials between the flowlines may cause fluid to flow from one flowline, through the formation and back into another flowline in the downhole tool, which may alter measurements, such as mobility and pressure.

Junction 151 may also be used to isolate portions of the fluid flow system downstream thereof from a portion of the fluid flow system upstream thereof. For example, junction 151 (i.e. by closing valves 144*a, b*) may be used to pass fluid from a position upstream of the junction to other portions of the downhole tool, for example through valve 144*j* and flowline 125 thereby avoiding the fluid flow circuits. In another example, by closing valves 144*a, b* and opening valve d, this configuration may be used to permit fluid to pass between the fluid circuits 150 and/or to other parts of the downhole tool through valve 144*k* and flowline 139. This configuration may also be used to permit fluid to pass between other components and the fluid flow circuits without being in fluid communication with the probe. This may be useful in cases, for example, where there are additional components, such as additional probes and/or fluid circuit modules, downstream of the junction.

Junction 151 may also be operated such that valve 144*a* and 144*d* are closed and 144*b* and 144*c* are open. In this configuration, fluid from both flowlines may be passed from a position upstream of junction 151 to flowline 135. Alternatively, valves 144*b* and 144*d* may be closed and 144*a* and 144*c* are open so that fluid from both flowlines may be passed from a position upstream of junction 151 to flowline 131.

The flow circuits 150*a* and 150*b* (sometimes referred to as sampling or fluid circuits) preferably contain pumps 136, sample chambers 142, valves 144 and associated flowlines for selectively drawing fluid through the downhole tool. One or more flow circuits may be used. For descriptive purposes, two different flow circuits are depicted, but identical or other variations of flow circuits may be employed.

Flowline 131 extends from junction 151 to flow circuit 150*a*. Valve 144*e* is provided to selectively permit fluid to flow into the flow circuit 150*a*. Fluid may be diverted from flowline 131, past valve 144*e* to flowline 133*a*1 and to the borehole through exit port 156*a*. Alternatively, fluid may be diverted from flowline 131, past valve 144*e* through flowline 133*a*2 to valve 144*f*. Pumps 136*a*1 and 136*a*2 may be provided in flowlines 133*a*1 and 133*a*2, respectively.

Fluid passing through flowline 133*a*2 may be diverted via valve 144*f* to the borehole via flowline 133*b*1, or to valve 144*g* via flowline 133*b*2. A pump 136*b* may be positioned in flowline 133*b*2.

Fluid passing through flowline 133*b*2 may be passed via valve 144*g* to flowline 133*c*1 or flowline 133*c*2. When diverted to flowline 133*c*1, fluid may be passed via valve 144*h* to the borehole through flowline 133*d*1, or back through flowline 133*d*2. When diverted through flowline 133*c*2, fluid is collected in sample chamber 142*a*. Buffer flowline 133*d*3 extends to the borehole and/or fluidly connects to flowline 133*d*2. Pump 136*c* is positioned in flowline 133*d*3 to draw fluid therethrough.

Flow circuit 150*b* is depicted as having a valve 144*e*' for selectively permitting fluid to flow from flowline 135 into flow circuit 150*b*. Fluid may flow through valve 144*e*' into flowline 133*c*1', or into flowline 133*c*2' to sample chamber 142*b*. Fluid passing through flowline 133*c*1' may be passed via valve 144*g*' to flowline 133*d*1' and out to the borehole, or to flowline 133*d*2'. Buffer flowline 133*d*3' extends from sample chamber 142*b* to the borehole and/or fluidly connects to flowline 133*d*2'. Pump 136*d* is positioned in flowline 133*d*3' to draw fluid therethrough.

A variety of flow configurations may be used for the flow control circuit. For example, additional sample chambers may be included. One or more pumps may be positioned in one or more flowlines throughout the circuit. A variety of valving and related flowlines may be provided to permit pumping and diverting of fluid into sample chambers and/or the wellbore.

The flow circuits may be positioned adjacently as depicted in FIG. 14. Alternatively, all or portions of the flow circuits may be positioned about the downhole tool and fluidly connected via flowlines. In some cases, portions of the flow circuits (as well as other portions of the tool, such as the probe) may be positioned in modules that are connectable in various configurations to form the downhole tool. Multiple flow circuits may be included in a variety of locations and/or configurations. One or more flowlines may be used to connect to the one or more flow circuits throughout the downhole tool.

An equalization valve 144*i* and associated flowline 149 are depicted as being connected to flowline 129. One or more such equalization valves may be positioned along the evaluation and/or cleanup flowlines to equalize the pressure between the flowline and the borehole. This equalization allows the pressure differential between the interior of the tool and the borehole to be equalized, so that the tool will not stick against the formation. Additionally, an equalization flowline assists in assuring that the interior of the flowlines is drained of pressurized fluids and gases when it rises to the surface. This valve may exist in various positions along one or more flowlines. Multiple equalization valves may be put inserted, particularly where pressure is anticipated to be trapped in multiple locations. Alternatively, other valves 144 in the tool may be configured to automatically open to allow multiple locations to equalize pressure.

A variety of valves may be used to direct and/or control the flow of fluid through the flowlines. Such valves may include check valves, crossover valves, flow restrictors, equalization, isolation or bypass valves and/or other devices capable of controlling fluid flow. Valves 144*a-k* may be on-off valves that selectively permit the flow of fluid through the flowline. However, they may also be valves capable of permitting a limited amount of flow therethrough. Crossover 148 is an example of a valve that may be used to transfer flow from the evaluation flowline 128 to the first sampling circuit and to transfer flow from the cleanup flowline to the second sampling circuit, and then switch the sampling flowing to the second sampling circuit and the cleanup flowline to the first sampling circuit.

One or more pumps may be positioned across the flowlines to manipulate the flow of fluid therethrough. The position of the pump may be used to assist in drawing fluid through certain portions of the downhole tool. The pumps may also be used to selectively flow fluid through one or more of the flowlines at a desired rate and/or pressure. Manipulation of the pumps may be used to assist in determining downhole fluid properties, such as formation fluid pressure, formation fluid mobility, etc. The pumps are typically positioned such that the flowline and valving may be used to manipulate the flow of fluid through the system. For example, one or more pumps may be upstream and/or downstream of certain valves, sample chambers, sensors, gauges or other devices.

The pumps may be selectively activated and/or coordinated to draw fluid into each flowline as desired. For example, the pumping rate of a pump connected to the cleanup flowline may be increased and/or the pumping rate of a pump connected to the evaluation flowline may be decreased, such that the amount of clean fluid drawn into the evaluation flowline is optimized. One or more such pumps may also be positioned along a flowline to selectively increase the pumping rate of the fluid flowing through the flowline.

One or more sensors (sometimes referred to herein as fluid monitoring devices), such as the fluid analyzers 146*a, b* (i.e. the fluid analyzers described in U.S. Pat. No. 4,994,671 and assigned to the assignee of the present invention) and pressure gauges 138*a, b, c*, may be provided. A variety of sensors may be used to determine downhole parameters, such as content, contamination levels, chemical (e.g., percentage of a certain chemical/substance), hydro mechanical (viscosity, density, percentage of certain phases, etc.), electromagnetic (e.g., electrical resistivity), thermal (e.g., temperature), dynamic (e.g., volume or mass flow meter), optical (absorption or emission), radiological, pressure, temperature, Salinity, Ph, Radioactivity (Gamma and Neutron, and spectral energy), Carbon Content, Clay Composition and Content, Oxygen Content, and/or other data about the fluid and/or associated downhole conditions, among others. As described above, fluid analyzers may collect optical measurements, such as optical density. Sensor data may be collected, transmitted to the surface and/or processed downhole.

Preferably, one or more of the sensors are pressure gauges 138 positioned in the evaluation flowline (138*a*), the cleanup flowline (138*b*) or across both for differential pressure therebetween (138*c*). Additional gauges may be positioned at various locations along the flowlines. The pressure gauges maybe used to compare pressure levels in the respective flowlines, for fault detection, or for other analytical and/or diagnostic purposes. Measurement data may be collected, transmitted to the surface and/or processed downhole. This data, alone or in combination with the sensor data may be used to determine downhole conditions and/or make decisions.

One or more sample chambers may be positioned at various positions along the flowline. A single sample chamber with a piston therein is schematically depicted for simplicity. However, it will be appreciated that a variety of one or more sample chambers may be used. The sample chambers may be interconnected with flowlines that extend to other sample chambers, other portions of the downhole tool, the borehole and/or other charging chambers. Examples of sample chambers and related configures may be seen in US Application No. 2003042021, U.S. Pat. Nos. 6,467,544 and 6,659,177, assigned to the assignee of the present invention. Preferably, the sample chambers are positioned to collect clean fluid. Moreover, it is desirable to position the sample chambers for efficient and high quality receipt of clean formation fluid. Fluid from one or more of the flowlines may be collected in one or more sample chambers and/or dumped into the borehole. There is no requirement that a sample chamber be included, particularly for the cleanup flowline that may contain contaminated fluid.

In some cases, the sample chambers and/or certain sensors, such as a fluid analyzer, may be positioned near the probe and/or upstream of the pump. It is often beneficial to sense fluid properties from a point closer to the formation, or the source of the fluid. It may also be beneficial to test and/or sample upstream of the pump. The pump typically agitates the fluid passing through the pump. This agitation can spread the contamination to fluid passing through the pump and/or increase the amount of time before a clean sample may be obtained. By testing and sampling upstream of the pump, such agitation and spread of contamination may be avoided.

Computer or other processing equipment is preferably provided to selectively activate various devices in the system. The processing equipment may be used to collect, analyze, assemble, communicate, respond to and/or otherwise process downhole data. The downhole tool may be adapted to perform commands in response to the processor. These commands may be used to perform downhole operations.

In operation, the downhole tool 110 (FIG. 12) is positioned adjacent the wellbore wall and the probe 118 is extended to form a seal with the wellbore wall. Backup pistons 119 are extended to assist in driving the downhole tool and probe into the engaged position. One or more pumps 136 in the downhole tool are selectively activated to draw fluid into one or more flowlines (FIG. 14). Fluid is drawn into the flowlines by the pumps and directed through the desired flowlines by the valves.

Pressure in the flowlines may also be manipulated using other device to increase and/or lower pressure in one or more flowlines. For example, pistons in the sample chambers and pretest may be retracted to draw fluid therein. Charging, valving, hydrostatic pressure and other techniques may also be used to manipulate pressure in the flowlines.

The flowlines of FIG. 14 may be provided with various sensors, such as fluid analyzer 146*a* in evaluation flowline 128 and fluid analyzer 146*b* in cleanup flowline 130. Additional sensors, 146*c* and 146*d* may also be provided at various locations along evaluation and cleanup flowlines 131 and 135, respectively. These sensors are preferably capable of measuring fluid properties, such as optical density, or other properties as described above. It is also preferable that these sensors be capable of detecting parameters that assist in determining contamination in the respective flowlines.

The sensors are preferably positioned along the flowlines such that the contamination in one or more flowlines may be determined. For example, when the valves are selectively operated such that fluid in flowlines 128 and 130 passes through sensor 146*a* and 146*b*, a measurement of the contamination in these separate flowlines may be determined. The fluid in the separate flowlines may be co-mingled or joined into a merged or combined flowline. A measurement may then be made of the fluid properties in such merged or combined flowlines.'

The fluid in flowlines 128 and 130 may be merged by diverting the fluid into a single flowline. This may be done, for example, by selectively closing certain valves, such as valves 144*a* and 144*d*, in junction 151. This will divert fluid in both flowlines into flowline 135. It is also possible to obtain a merged flowline measurement by permitting flow into probe 120 using flowline 128 or 130, rather than both. A combined or merged flowline may also be fluidly connected to one or more inlets in the probe such that fluid that enters the tool is co-mingled in a single or combined flowline.

It is also possible to selectively switch between merged and separate flowlines. Such switching may be done automatically or manually. It may also be possible to selectively adjust pressures between the flowlines for relative pressure differentials therebetween. Fluid passing through only flowline 128 may be measured by sensor 146*a*. Fluid passing through only flowline 130 may be measured by sensor 146*b*.

The flow through flowlines 128 and 130 may be manipulated to selectively permit fluid to pass through one or both flowlines. Fluid may be diverted and/or pumping through one or more flowlines adjusted to selectively alter flow and/or contamination levels therein. In this manner, fluid passing through various sensors may be fluid from evaluation flowline 128, cleanup flowline 130 or combinations thereof. Flow rates may also be manipulated to vary the flow through one or more of the flowlines. Fluid passing through the individual and/or merged flowlines may then be measured by sensors in the respective flowlines. For example, once merged into flowline 135, the fluid may be measured by sensor 146*d*.

Using the flow manipulation techniques described with respect to FIG. 14, fluid may be manipulated as desired to selectively flow past certain sensors to take measurements and/or calibrate sensors. The sensors may be calibrated by selectively passing fluid across the sensors and comparing measurements. Calibration may occur simultaneously by drawing fluid into two lines simultaneously and comparing the readings. Calibration may also occur sequentially by comparing readings of the same fluid as it passes multiple sensors to verify consistent readings. Calibration may also occur by recirculating the same fluid past one or more sensor in a flowline.

The fluid from separate flowlines may also be compared and analyzed to detect various downhole properties. Such measurements may then be used to determine contamination levels in the respective flowlines. An analysis of these measurements may then be used to evaluate properties based on merged flowline data and the flowline data in individual flowlines.

A simulated merged flowline may be achieved by mathematically combining the fluid properties of the evaluation and cleanup flowlines. By combining the measurements taken at sensors for each of the separate evaluation and cleanup flowlines, a combined or merged flowline measurement may be determined. Thus, a merged flowline parameter may be obtained either mathematically or by actual measurement of fluid combined in a single flowline.

Figure 15A:
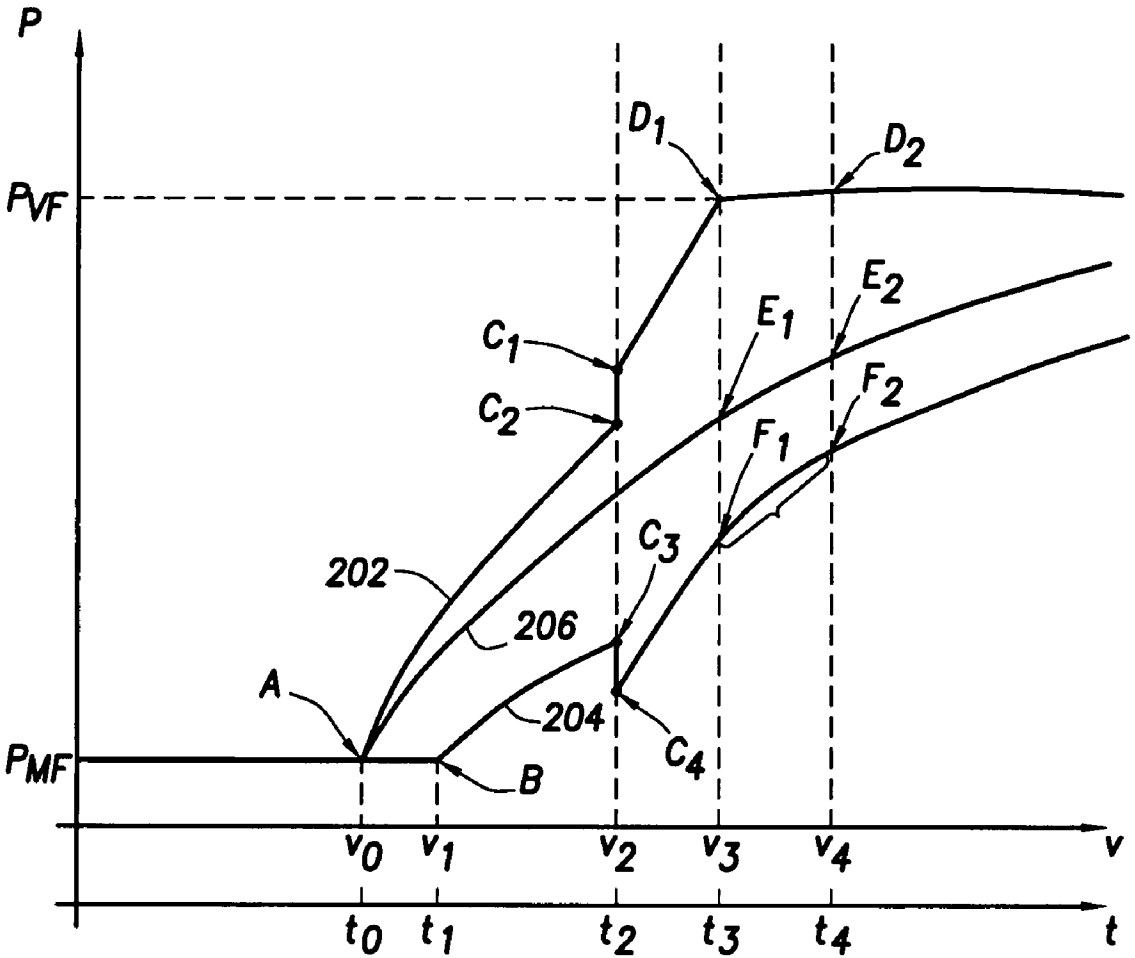
FIG. 15A is a graph of a fluid property of flowlines of the fluid flow system of FIG. 14 using a flow stabilization technique.
Figure 15B:
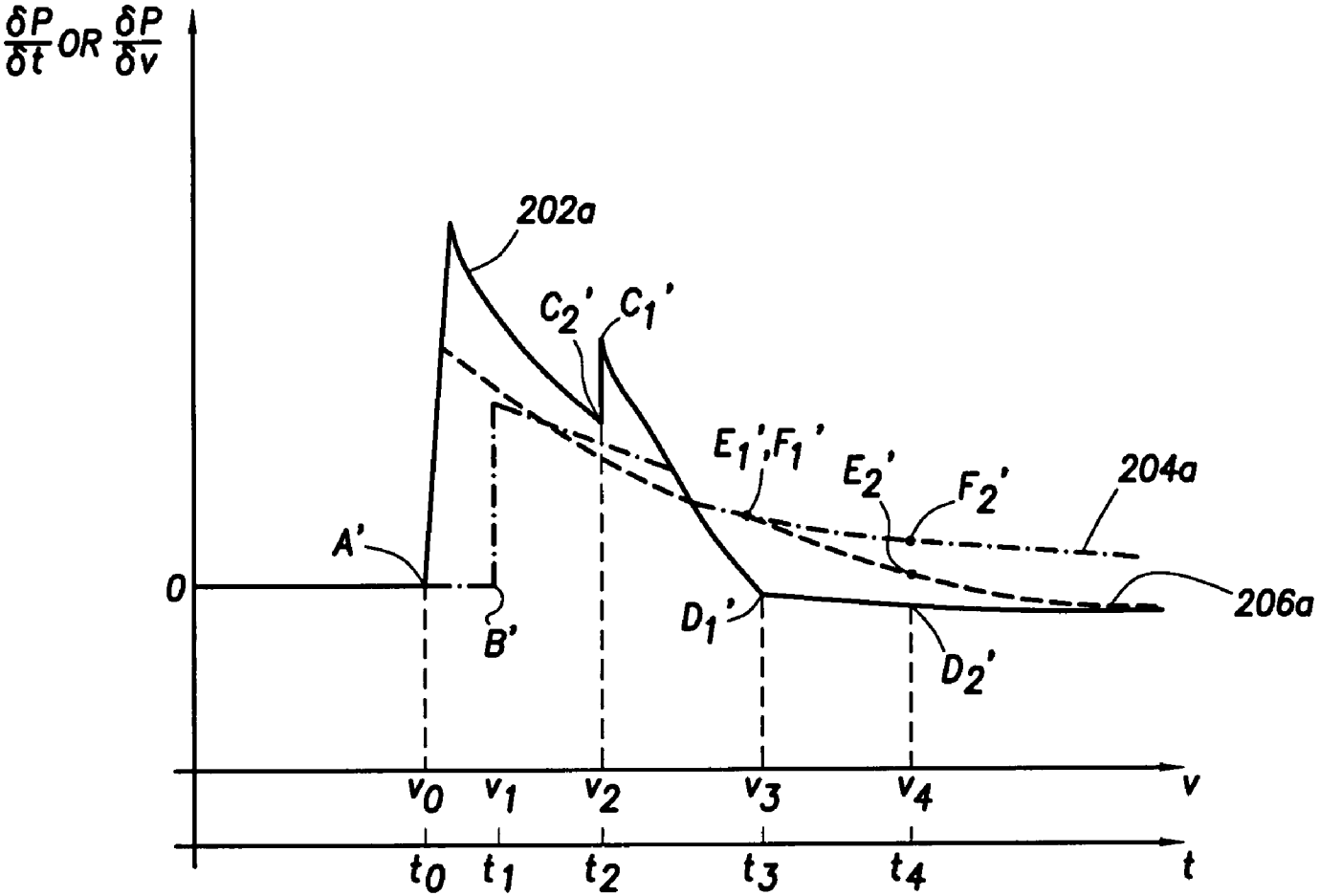
FIG. 15B is a graph of derivatives of the property functions of FIG. 15A.

FIGS. 15A and 15B describe techniques for analyzing contamination of fluid passing into a downhole tool, such as the tool of FIG. 14, using a stabilization technique. FIG. 15A depicts a graph of a fluid property P measured across an evaluation flowline (such as 128 of FIG. 4), a cleanup flowline (such as 130 of FIG. 4) and a merged flowline (such as 135 of FIG. 4) using a stabilization technique. The merged flowline may be generated by co-mingling fluid in the evaluation and cleanup flowlines, or by mathematically determining fluid properties for a merged flowline as described above.

The graph depicts the relationship between a fluid property P (y-axis) versus fluid volume (x-axis) or time (x-axis) for the flowlines. The fluid property may be, for example, the optical density of fluid passing through the flowlines. Other fluid properties may be measured, analyzed, predicted and/or determined using methods provided herein. Preferably, the volume is the total volume withdrawn into the tool through one or more flowlines.

The fluid property P is a physical property of the fluid that distinguishes between mud filtrate and virgin fluid. The property depicted in FIG. 15A is, for example, an optical property, such as optical density, measurable using a fluid analyzer. Mixing laws establish that the physical property P is a function of and corresponds to a contamination level according to the following equation:

$$P=cPmf+(1-c)Pvf \tag{1}$$

where Pmf is the mud filtrate property corresponding to a contamination level of 1 or 100% contamination, Pvf is a virgin fluid property corresponding to a contamination level of 0 or 0% and c is the level of contamination for the fluid. Rearranging the equation generates the following contamination level c for a given fluid property:

$$c = \frac{P - Pvf}{Pmf - Pvf} \tag{2}$$

The fluid property may be graphically expressed in relationship to time or volume as shown in FIG. 15A. In other words, the x-axis may be represented in terms of volume or time given the known relationship of time and volume through flowrate.

In the example shown in FIG. 15A, fluid is drawn into evaluation flowline 128, cleanup flowline 130, and passes through sensors 146*a* and 146*b*. A merged flowline measurement may be obtained by combining the measurements taken by sensors 146*a* and 146*b*, or by merging the fluid into a single flowline, for example into flowline 135 for measurement by sensor 146*d* as described above. The resulting data for the evaluation flowline, cleanup flowline and merged flowline are depicted as lines 202, 204 and 206, respectively.

Fluid is drawn into the flowlines from time 0, volume 0 until time t0, volume v0. Initially, the fluid property P is registered at Pmf (mud filtrate). As described above, Pmf relates to the optical density level that is present when mud filtrate is lining the wellbore wall as shown in FIG. 1. The contamination level at Pmf is assumed to be a high level, such as about 100%. At this point A, the virgin fluid breaks through the mud cake and begins to pass through the flowlines as shown in FIG. 2. The increase in the fluid property measurement reads as an increase in property P along the Y axis. The cleanup flowline typically does not begin to increase until point B at time t1 and volume V1. At point B, a portion of the clean fluid begins to enter the cleanup flowline.

Points C1-C4 show that variations in flow rates may alter the fluid property measurement in the flowline. At time t2 and volume V2, the fluid property measurement in the evaluation flowline shifts from C2 to C1, and the fluid property measurement in the cleanup flowline shifts from C3 to C4 as the flow rates therein are shifted. In this case, the flow in cleanup flowline 130 is increased relative to the flow rate in evaluation flowline 128 thereby decreasing the fluid property measurement in the cleanup flowline while increasing the fluid property measurement in the evaluation flowline. This may, for example, show an increase in clean fluid from points C2 to C1 and a decrease in clean fluid in line 204 from points C3 to C4. While FIG. 15A shows that a shift has occurred as a specific shift in flow rate, flow may decrease in the cleanup line and/or an increase in flow rate in the evaluation flowline, or remain the same in both flowlines.

As flow into the tool continues, the fluid property of the merged flowline is steadily increasing as indicated by line 206. However, the fluid property of the evaluation flowline increases until a stabilization level is reached at point D1. At point D1, the fluid property in the evaluation flowline is at or near Pvf. As described above with respect to FIGS. 11A-C, Pvf at point D1 is considered to be the time when only virgin fluid is passing into the evaluation flowline. At Pvf, the fluid in the evaluation flowline is assumed to be virgin, or at a contamination level of at or approaching zero.

At time t3 and volume V3, the evaluation flowline is essentially drawing in clean fluid, while the cleanup flowline is still drawing in contaminated fluid. The fluid property measurement in flowline 128 remains stabilized through time t4 and volume V4 at point D2. In other words, the fluid property measurement at point D2 is approximately equal to the fluid property measurement at point D1.

From time t3 to t4 and volume V3 to V4, the fluid property in the merged and cleanup flowlines continue to increase as shown at points E1 and E2 of line 206 and points F1 and F2 of line 204, respectively. This indicates that contamination is still flowing into the contaminated and/or merged flowlines, but that the contamination level continues to lower.

As shown in FIG. 15B, the properties depicted in the graph of FIG. 15A may also be depicted based on derivatives of the measurements taken. FIG. 15B depicts the relationship between the derivative of the fluid property versus volume and time, or $$\frac{\partial P}{\partial t}.$$

The evaluation, cleanup and merged flowlines are shown as lines 202*a*, 204*a* and 206*a*, respectively. Points A-F2 correspond to points A'-F2', respectively. Thus, stabilization of the evaluation flowline occurs from points D1' to D2' at $$\frac{\partial P}{\partial t} \approx 0,$$

and fluid property measurements in the merged and cleanup flowlines continue to increase from points E1' to E2' and F1' to F2' where $$\frac{\partial P}{\partial t} > 0.$$

While only a first level derivative is depicted, higher orders of derivatives may be used.

Stabilization of fluid properties in the evaluation flowline from points D1 to D2 can be considered as an indication that complete cleanup is achieved or approached. The stabilization can be verified by determining whether one or more additional events occurred during cleanup monitoring. Such events may include, for example, break through of virgin formation fluid on the evaluation and/or cleanup flowlines (points A and/or B on FIG. 15A) through the probe prior to stabilization (points D1-D2 on FIG. 15A), continued variation of fluid property in the cleanup and/or merged flowline (points E1 to E2 and/or F1 or F2 on FIG. 15A) and/or continued variation in the direction consistent with clean up in the cleanup and/or merged flowline.

As soon as stabilization of the fluid property in the evaluation flowline is confirmed, cleanup may be assumed to have occurred in the evaluation flowline. Such cleanup means that a minimum contamination level has been achieved for the evaluation flowline. Typically, that cleanup results in a virgin fluid passing through the evaluation flowline. This method does not require contamination quantification and is based at least in part on qualitative detection of fluid property variation signature.

The graph of FIG. 15A shows that the amount virgin fluid is entering the flowlines is increasing. As contamination in the flowline is reduced, 'cleanup' occurs. In other words, more and more contaminated fluid is removed so that more virgin fluid enters the tool. In particular, cleanup occurs when virgin fluid enters the evaluation flowline. The increase in virgin fluid is reflected as an increase in fluid properties. However, it will be appreciated that in some cases, cleanup may not occur due to a bad seal or other problems. In such cases where the fluid property fails to increase, this may indicate a problem in the formation evaluation process.

Figure 16:
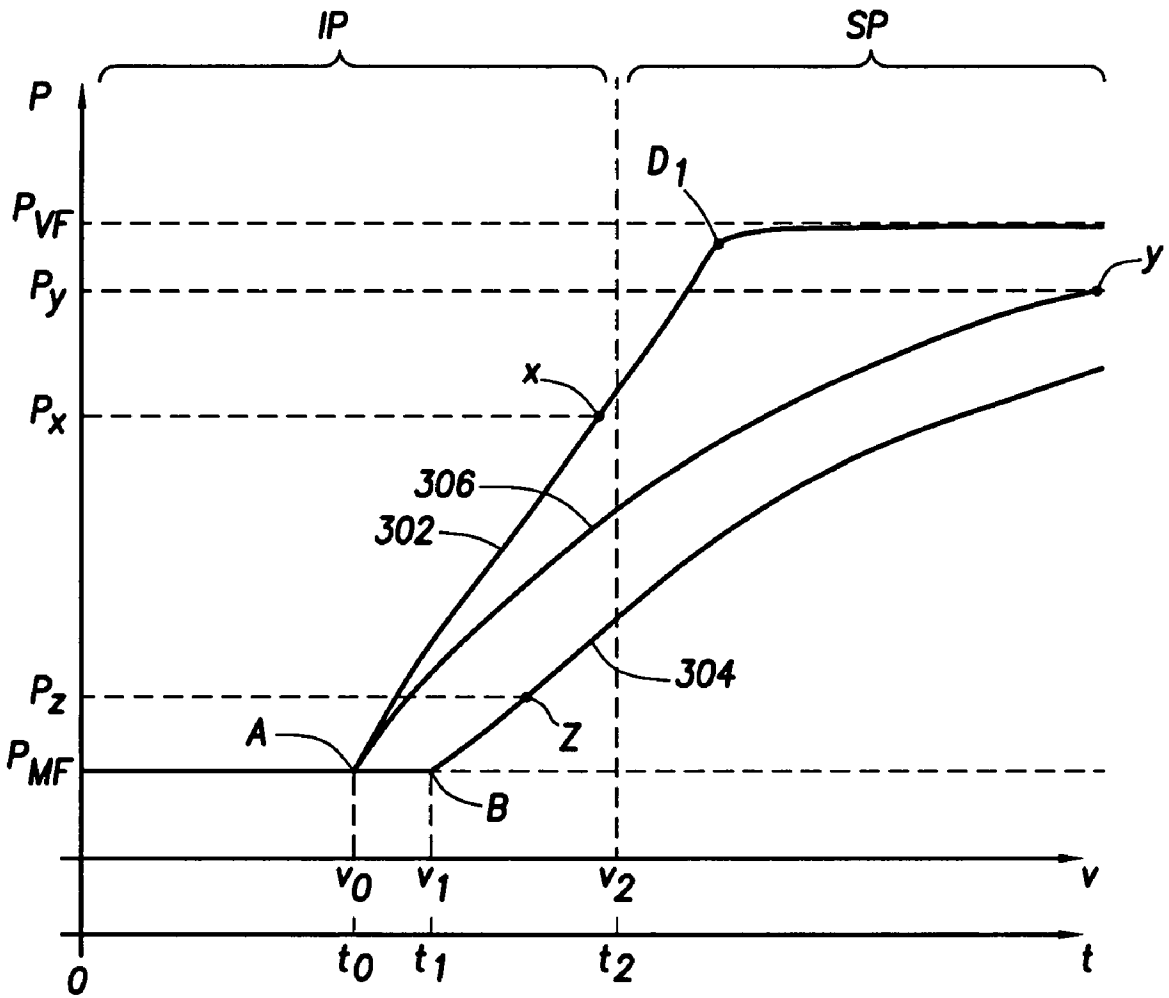
FIG. 16 is a graph of a fluid property of the flowlines of the fluid flow system of FIG. 14 using a projection technique.

FIG. 16 shows a graph of the relationship between a fluid property P versus time and volume using a projection technique. The fluid may be drawn into the tool using the evaluation and/or cleanup flowlines as previously described with respect to FIG. 14. FIG. 16 also depicts that the selective merging of the contamination and cleanup flowlines may be used to generate a merged flowline.

As shown in FIG. 16, fluid is drawn into the downhole tool and a fluid property in the flowline(s) is measured. The technique of FIG. 16 may be accomplished by drawing fluid into a single or merged flowline in the tool during an initial phase IP, and then switching so that fluid is drawn into the tool using an evaluation and a cleanup flowline during a secondary phase SP. In one example, this is done by allowing fluid through the evaluation flowline to generate a merged line 306 as described above with respect to FIG. 14. Alternatively, fluid may be drawn into an evaluation flowline and a cleanup flowline to generate lines 302 and 304, respectively. A resultant merged line 306 may be generated by mathematically determining the combined contamination, or by merging the flowlines and measuring the resultant contamination in the tool as described above.

The merged flowline may extend from the initial phase and continue to generate a curve 306 through the secondary phase. The separate evaluation and cleanup flowlines may also extend from the initial phase and continue to generate their curves 302, 304 through the secondary phase. In some cases, the separate evaluation and cleanup curves may extend through only the initial phase or only the secondary phase. In some cases, the merged evaluation curve may extend through only the initial phase or only the secondary phase. Various combinations of each of the curves may be provided.

In some cases, it may be desirable to start with merged or flow through a single flowline. In particular, it may be desirable to use single or merged flow until virgin fluid break through occurs. This may have the beneficial effect of relieving pressure on the probe and preventing failure of the probe packer(s). The pressure differentials between the flowlines may be manipulated to protect the probe, prevent cross flow, reduce contamination and/or prevent failures.

This merging of the flowlines may be accomplished by manipulating the apparatus of FIG. 14 or mathematically generating the combined flowline as described above. The sensors may be used to measure a fluid property, such as optical density, and a flow rate for each of the evaluation, cleanup and/or combined flowlines.

For illustrative purposes the evaluation, cleanup and merged flowlines will be shown through both the initial and secondary phases. As shown in FIG. 16, fluid is drawn into the tool from a time 0 and volume 0 with a fluid property at Pmf. At time t0 and volume V0 at point A, the virgin fluid breaks through the mudcake and clean fluid begins to enter the tool. At point A, the fluid properties for the merged and evaluation flowlines begin to increase. The merged flowline fluid property increased through the secondary phase through a level Py at point Y as indicated by line 306. The evaluation flowline fluid property continues to increase through point X at a level Py and into the secondary phase, but begins to stabilize at a point D1 at or near the fluid property level Pvf. The cleanup flowline remains at level Pmf until it reaches point B at time t1 and volume V1. The fluid property for the cleanup flowline increases through a fluid property level PZ at point Z through the second phase SP.

The flow rates as depicted in FIG. 16 remain constant, but may also shift as shown at points C1-2 of FIG. 15A. The stabilization level of the evaluation flowline may also be determined in FIG. 16 using the techniques described in FIG. 15A.

Figure 17:
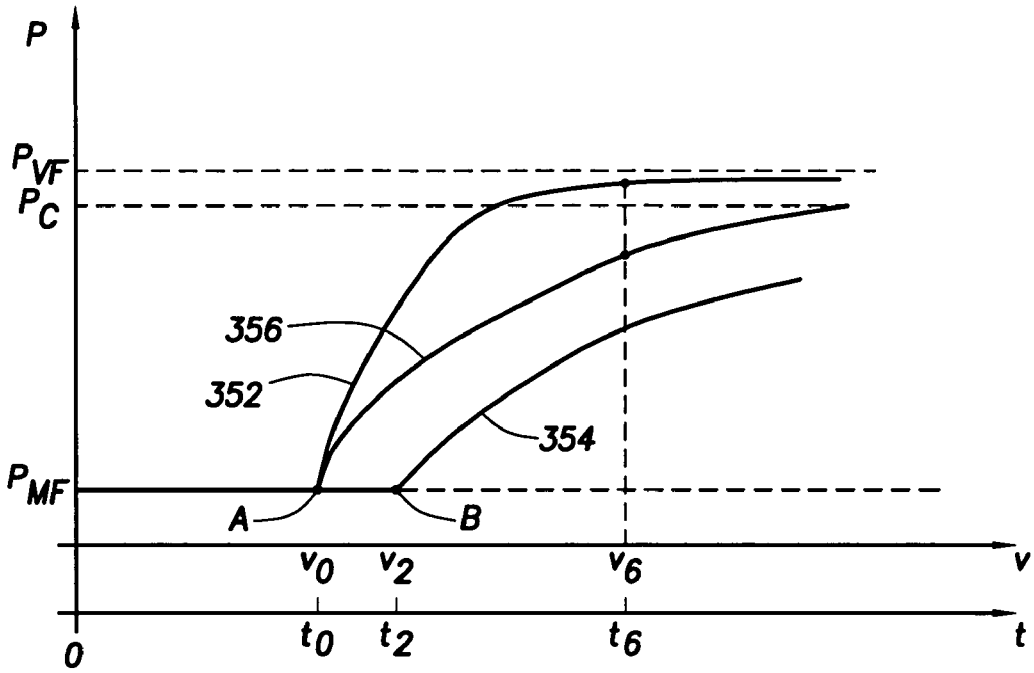
FIG. 17 is a graph depicting the contamination models for merged and a separate flowlines.

FIG. 17 shows a graph of the relationship between the measured fluid property in an evaluation flowline (352) and a merged flowline (356). Both flowlines begin at the level Pmf indicating a high contamination level before breakthrough. At time t0 and volume V0, breakthrough occurs at point A and contamination levels begin to drop as the fluid property increases. Break through for the contamination line occurs at point B at time t2 and volume V2. At time t6, volume V6, the evaluation flowline begins to stabilize, while the combined flowline continues a slower but steady increase. According to known techniques, the combined flowline will continue to draw some portion of contamination fluid and reach a fluid property level Pc below the zero contamination level of Pvf. However, the evaluation flowline will begin to approach a zero contamination level at Pvf.

An estimate of Pvf and Pmf may be determined using various techniques. Pmf may be determined by measuring a fluid property prior to virgin fluid break through (point A on FIG. 16). Pmf may also be estimated, for example based on empirical data or known properties, such as the specific mud used in the wellbore.

Pvf may be determined by a variety of methods using a merged or combined flowline. A combined flowline is created using the techniques described above with reference to FIG. 14. In one example using the equation below under a known mixing law, for each time and/or volume a weighted combined fluid property value Pt can be calculated:

$$Pt = \frac{PsQs + PgQg}{Qs + Qg} \tag{3}$$

where Ps is the fluid property value in the evaluation flowline, Pg is the fluid property in the cleanup flowline, Qs is the flow rate in the evaluation flowline and Qg is the flow rate in the cleanup flowline. The values Pt over the sampling interval may then be plotted to define, for example, a line 356 for the merged flowline. Further information concerning various mixing laws that can be used to generate equation (3) or variations thereof are described in Published PCT Application No. WO 2005065277 previously incorporated herein.

From the fluid properties represented by line 356, Pvf may be determined, for example, by applying the contamination modeling techniques as described in P. S. Hammond, "One or Two Phased Flow During fluid Sampling by a Wireline Tool," *Transport in Porous Media*, Vol. 6, p. 299-330 (1991). The Hammond models may then be applied using the relationship between contamination and a fluid property using equation (2). Using this application of the Hammond technique Pvf may be estimated. Other methods, such as the curve fit techniques described in PCT Application No. 00/50876, based on combined flowline properties may also be used to determine Pvf.

Once you have Pmf and Pvf, a contamination level for any flowline may be determined. A fluid property, such as Px, Py or Pz is measured for the desired flowline at points X, Y and Z on the graph of FIG. 16. The contamination level of each of the flowlines may be determined based on the properties of the merged flowline. Once Pvf and Pmf are known, and one parameter, such as Px, Py or Pz, on a given flowline is known, then the contamination level for that flowline can be determined. For example, in order to determine a contamination level at Px, Py or Pz, equation (2) above may be used.

Figure 18:
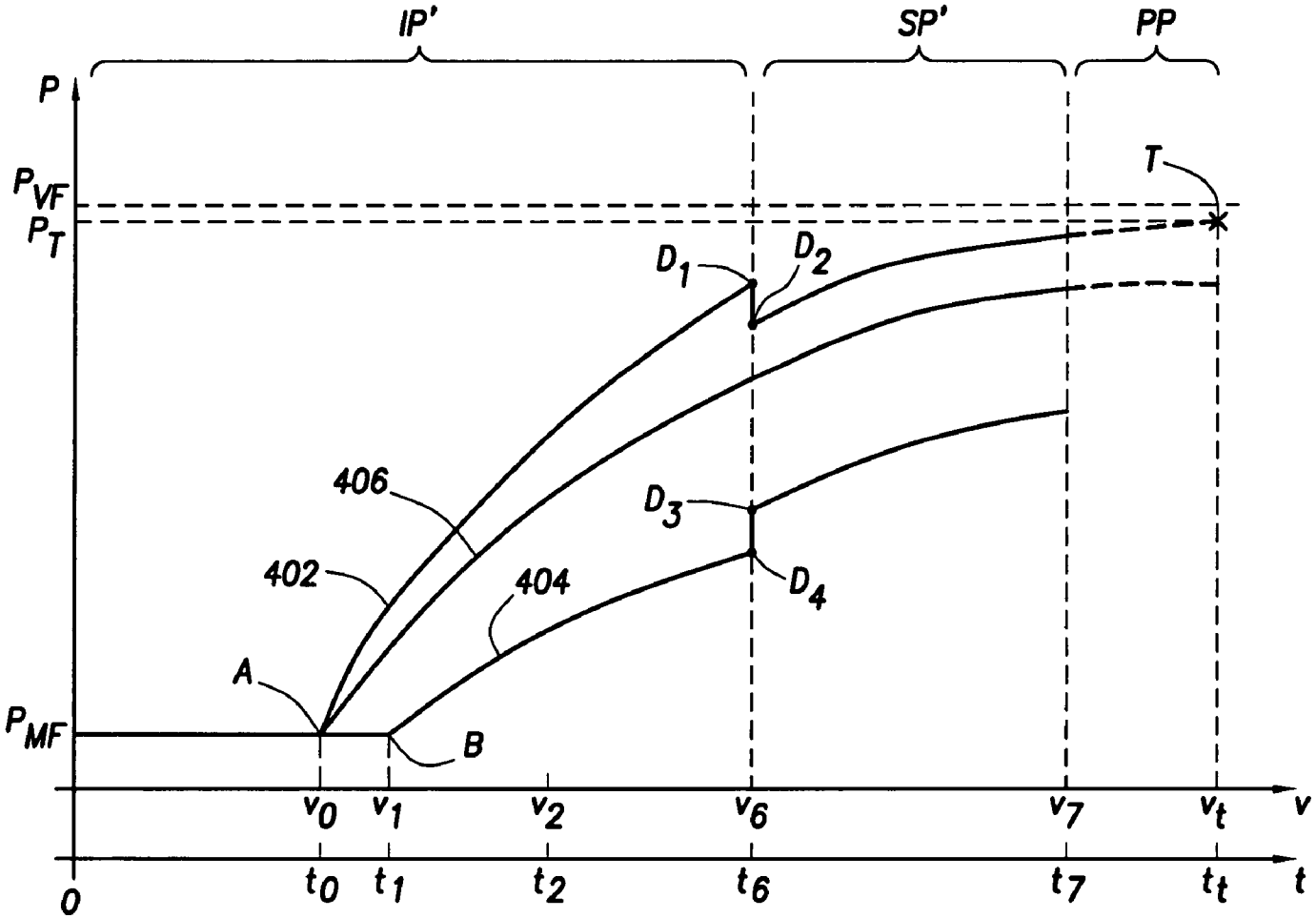
FIG. 18 is a graph of a fluid property of the flowlines of the fluid flow system of FIG. 14 using a time estimation technique.

FIG. 18 shows a graph of the relationship between a fluid property versus time and volume using a time estimation technique. In particular, FIG. 18 relates to the estimation of cleanup times generated using evaluation, merged and cleanup flowlines. The fluid may be drawn into the tool using the evaluation and/or cleanup flowlines as previously described with respect to FIG. 14.

Lines 402, 404 and 406 depict the fluid property levels for the evaluation, cleanup and merged flowlines, respectively. As described with respect to FIGS. 15A and 16, the fluid property for the evaluation and combined flowlines increases at point A after the virgin fluid breaks through. These lines continue to increase through an initial phase IP'. At time t6 and volume V6, the flow rates shift and the fluid property briefly lowers from point D1 to D2 in the evaluation flowline as flow into the evaluation flowline increases. A corresponding reduction in flow rate in the cleanup flowline causes the cleanup line 404 to shift from Points D3 to D4. The evaluation and cleanup flowlines then continue to increase through second phase SP'. In the example shown, no corresponding change is seen in the combined flowline and it continues to increase steadily into the second phase SP'. As described above with respect to FIGS. 15A and 16, the shift due to changes in flow rate may occur in a variety of ways or not at all.

In some cases, such as those shown in FIGS. 15A, 15B and 16, the fluid properties are known for a given time period. In some cases, the fluid property for one or more flowlines may not be known. The fluid properties and the corresponding line may be generated using the techniques described with respect to FIG. 16. Plots may be estimated for a into a future phase PP by projecting fluid property estimates beyond time t7 and volume V7.

It may be desirable to determine when the evaluation flowline reaches a target contamination level $P_T$. In order to determine this, the information known about the existing flowlines and their corresponding fluid properties P may be used to predict future parameter levels. For example, the merged flowline may be projected into a future projection phase PP.

The relationship between the merged and evaluation flowlines may then be used to extend a corresponding projection for line 402 into the projection phase PP using the techniques described with respect to FIG. 16. The point T at which the evaluation flowline meets a target parameter level that corresponds to a desired contamination level may then be determined. The time to reach point T may then be determined based on the graph.

The merged flowline parameter line 406 may be determined using the techniques described with respect to FIGS. 16 and 17. The merged flowline parameter line 406 may then be projected into the future beyond time t7 and into the projected phase PP. The evaluation line 402 may then be extended into the projected phase PP based on the projected merged flowline 406 and the relationship depicted in FIG. 19.

Figure 19:
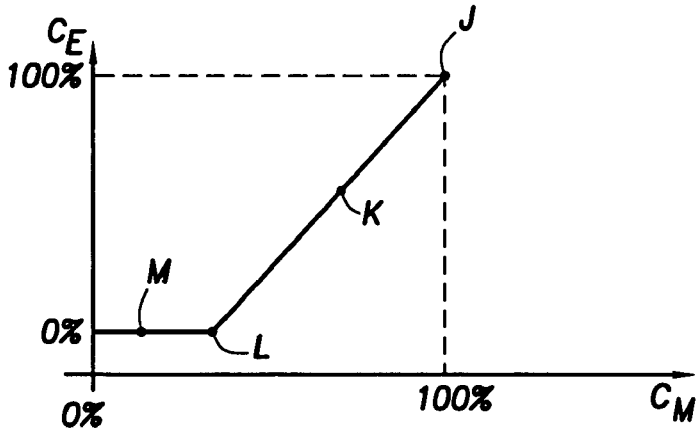
FIG. 19 is graph depicting the relationship between percent contamination for an evaluation flowline versus a combined flowline.

FIG. 19 shows a graph of an example of a relationship between the percent contamination of a combined flowline $C_M$ (x-axis) versus the percent contamination of an evaluation flowline $C_E$ (y-axis). The relationship of contamination in the flowlines may be determined empirically. At point J, fluid is initially drawn into the evaluation and combined flowline. Contamination level is at 100% since the no virgin fluid has broken through or is flowing into the tool. Once the virgin fluid breaks through, the contamination level begins to drop to point K. As cleanup continues, contamination levels continue to drop until fluid in the evaluation flowline is virgin at point L. Cleanup continues until the amount of contaminated fluid entering the cleanup flowline continues to reduce to point M.

The graph of FIG. 19 shows a relationship between the evaluation and combined flowline. This relationship may be determined using empirical data based on the relationship between flow rate in the evaluation flowline Qs and the flow rate in the evaluation flowline Qp. The relationship may also be determined based on rock properties, fluid properties, mud cake properties and/or previous sampling history, among others. From this relationship, the line 402 for the evaluation flowline may be projected based on the projected line 406 of the combined flowline. The point at which the projected evaluation line 402 reaches Target point occurs at time tT and volume Vt. This time tT is the time to reach the target cleanup.

The techniques described in relation to FIGS. 15A-19 can be practiced with any one of the fluid sampling systems described above. The various methods described for FIGS. 15A, 15B, 16 and 18 may be interchanged. For example, the calibration procedures described herein may be used in combination with any of these methods. Additionally, the method of projection and/or determining a time to reach a target contamination may be combined with the methods of FIGS. 15A, 15B and/or 16.

It will be understood from the foregoing description that various modifications and changes may be made in the preferred and alternative embodiments of the present invention without departing from its true spirit. The devices included herein may be manually and/or automatically activated to perform the desired operation. The activation may be performed as desired and/or based on data generated, conditions detected and/or analysis of results from downhole operations.

This description is intended for purposes of illustration only and should not be construed in a limiting sense. The scope of this invention should be determined only by the language of the claims that follow. The term "comprising" within the claims is intended to mean "including at least" such that the recited listing of elements in a claim are an open group. "A," "an" and other singular terms are intended to include the plural forms thereof unless specifically excluded.

It should also be understood that the discussion and various examples of methods and techniques described above need not include all of the details or features described above. Further, neither the methods described above, nor any methods which may fall within the scope of any of the appended claims, need be performed in any particular order. Yet further, the methods of the present invention do not require use of the particular embodiments shown and described in the present specification, such as, for example, the exemplary probe 28 of FIG. 5, but are equally applicable with any other suitable structure, form and configuration of components.

Preferred embodiments of the present invention are thus well adapted to carry out one or more of the objects of the invention. Further, the apparatus and methods of the present invention offer advantages over the prior art and additional capabilities, functions, methods, uses and applications that have not been specifically addressed herein but are, or will become, apparent from the description herein, the appended drawings and claims.

While preferred embodiments of this invention have been shown and described, many variations, modifications and/or changes of the apparatus and methods of the present invention, such as in the components, details of construction and operation, arrangement of parts and/or methods of use, are possible, contemplated by the applicant, within the scope of the appended claims, and may be made and used by one of ordinary skill in the art without departing from the spirit or teachings of the invention and scope of appended claims. Because many possible embodiments may be made of the present invention without departing from the scope thereof, it is to be understood that all matter herein set forth or shown in the accompanying drawings is to be interpreted as illustrative and not limiting. Accordingly, the scope of the invention and the appended claims is not limited to the embodiments described and shown herein.

What is claimed is:

1. A method of evaluating a fluid from a subterranean formation drawn into a downhole tool positioned in a wellbore penetrating the subterranean formation, comprising:

drawing fluid from a formation into an evaluation flowline;

drawing fluid from a formation into a cleanup flowline;

measuring a property of the fluid in the evaluation flowline, the fluid property being a physical property of the fluid that distinguishes between mud filtrate and virgin fluid, wherein the fluid property is optical density; and detecting stabilization of the property of the fluid in the evaluation flowline.

2. The method of claim 1 further comprising measuring a property of the fluid in the cleanup flowline.

3. The method of claim 2 further comprising verifying stabilization by detecting an increase in the fluid property in the cleanup flowline during stabilization.

4. The method of claim 1 further comprising establishing a combined flowline from the evaluation and cleanup flowlines and measuring a property of the combined flowline.

5. The method of claim 4 further comprising detecting an increase in the fluid property in the combined flowline.

6. The method of claim 1 further comprising converting the fluid property to a contamination level.

7. The method of claim 1 further comprising taking at least one derivative of the measured property of the evaluation flowline.

8. The method of claim 1, wherein stabilization occurs when the property of the evaluation flowline at two successive points is substantially the same.

9. The method of claim 1, wherein stabilization occurs when a derivative of the property of the evaluation flowline at two successive points is equal to zero.

10. The method of claim 1, further comprising calibrating at least one sensor of the downhole tool, the at least one sensor adapted to measure the property of the flowlines.

11. The method of claim 1, further establishing a combined flowline from the evaluation and cleanup flowlines and estimating at least one future fluid property for the combined flowline.

12. The method of claim 11, further comprising estimating at least one future fluid property of an evaluation flowline from the at least one future fluid property of the combined flowline.

13. The method of claim 12, further comprising determining a time when the at least one future fluid property of the evaluation flowline reaches a target property level.

14. The method of claim 11, further comprising determining a fluid property of one of the evaluation flowline, the cleanup flowline, the combined flowline and combinations thereof.

15. The method of claim 14, further comprising determining a contamination level corresponding to the determined fluid property.

16. A method of evaluating a fluid from a subsurface formation drawn into a downhole tool positioned in a wellbore penetrating the subterranean formation, comprising:

drawing fluid from the formation into an evaluation flowline;

drawing fluid from a formation into a cleanup flowline;

generating a combined flowline from the evaluation and cleanup flowlines;

determining a virgin fluid break through property (Pmf) and a virgin fluid property (Pvf) for the combined flowline;

measuring at least one fluid property of one of the evaluation flowline, the cleanup flowline, the combined flowline and combinations thereof; and determining a contamination level for the at least one fluid property from the virgin fluid breakthrough parameter (Pmf), the virgin fluid property (Pvf) and the measured fluid property (Pd).

17. The method of claim 16, wherein Pmf is determined by measuring at least one property of the fluid prior to the break through of virgin fluid.

18. The method of claim 16, wherein Pvf is determined based on combined fluid models.

19. The method of claim 16, wherein the combined flowline is generated by combining fluid in the evaluation and cleanup flowlines.

20. The method of claim 16, wherein the combined flowline is generated by mathematically determining combined flowline from the evaluation and cleanup flowlines.

21. The method of claim 16, further comprising estimating at least one future fluid property of the combined flowline.

22. The method of claim 21, further comprising estimating at least one future fluid property of an evaluation flowline from the at least one future fluid property of the combined flowline.

23. The method of claim 22, further comprising determining a time when the at least one future fluid property of the evaluation flowline reaches a target property level.

24. The method of claim 16, further comprising calibrating at least one sensor of the downhole tool, the at east one sensor adapted to measure the property of the flowlines.

25. The method of claim 16, further comprising determining the stabilization of the property of the fluid in the evaluation flowline.

26. A method of evaluating a fluid from a subsurface formation drawn into a downhole tool positioned in a wellbore penetrating the subterranean formation, comprising:

drawing fluid from the formation into an evaluation flowline;

drawing fluid from a formation into a cleanup flowline;

generating a combined flowline from the evaluation and cleanup flowlines;

determining at least one initial fluid property of the fluid in the combined flowline for an initial period of time;

estimating at least one projected combined parameter of the fluid for a future period of time for the combined flowline;

estimating at least one projected evaluation parameter of the fluid for the evaluation flowline for the future period of time based on the estimated projected combined parameter; and determining the time when the projected evaluation parameter reaches a target contamination level.

27. The method of claim 16, wherein the combined flowline is generated by combining fluid in the evaluation and cleanup flowlines.

28. The method of claim 16, wherein the combined flowline is generated by mathematically determining combined fluid properties from the evaluation and cleanup flowlines.

29. The method of claim 16, further comprising detecting stabilization of the property of the fluid in the evaluation flowline.

30. The method of claim 29 further comprising measuring at least one property of the fluid in the cleanup flowline.

31. The method of claim 30 further comprising verifying stabilization by detecting an increase in the fluid property in the cleanup flowline.

32. The method of claim 29 further comprising establishing a combined flowline from the evaluation and cleanup flowlines and measuring a property of the combined flowline.

33. The method of claim 32 further comprising detecting an increase in the fluid property in the combined flowline.

34. The method of claim 29 wherein the fluid property is optical density.

35. The method of claim 29 further comprising converting the fluid property to a contamination level.

36. The method of claim 29 further comprising taking at least one derivative of the measured property of the evaluation flowline.

37. The method of claim 29, wherein stabilization occurs when the property of the evaluation flowline at two successive points is substantially the same.

38. The method of claim 29, wherein stabilization occurs when a derivative of the property of the evaluation flowline at two successive points is equal to zero.

39. The method of claim 29, further comprising calibrating at least one sensor of the downhole tool, the at least one sensor adapted to measure the property of the flowlines.

40. The method of claim 1 further comprising modifying at least one of a flow rate in the evaluation flow line and a flow rate in the cleanup flow line.

41. The method of claim 40 wherein modifying at least one of a flow rate in the evaluation flow line and a flow rate in the cleanup flow comprises modifying a flow rate ration between the evaluation flow line and the cleanup flow line.

42. A method of evaluating a fluid from a subterranean formation drawn into a downhole tool positioned in a wellbore penetrating the subterranean formation, comprising:

drawing fluid from a formation into an evaluation flowline;

drawing fluid from a formation into a cleanup flowline;

measuring a property of the fluid in the evaluation flowline, the fluid property being a physical property of the fluid that distinguishes between mud filtrate and virgin fluid;

detecting stabilization of the property of the fluid in the evaluation flowline;

measuring a property of the fluid in the cleanup flowline; and verifying stabilization by detecting an increase in the fluid property in the cleanup flowline during stabilization.

43. A method of evaluating a fluid from a subterranean formation drawn into a downhole tool positioned in a wellbore penetrating the subterranean formation, comprising:

drawing fluid from a formation into an evaluation flowline;

drawing fluid from a formation into a cleanup flowline;

measuring a property of the fluid in the evaluation flowline, the fluid property being a physical property of the fluid that distinguishes between mud filtrate and virgin fluid;

detecting stabilization of the property of the fluid in the evaluation flowline;

establishing a combined flowline from the evaluation and cleanup flowlines; and measuring a property of the combined flowline.

44. A method of evaluating a fluid from a subterranean formation drawn into a downhole tool positioned in a wellbore penetrating the subterranean formation, comprising:

drawing fluid from a formation into an evaluation flowline;

drawing fluid from a formation into a cleanup flowline;

measuring a property of the fluid in the evaluation flowline, the fluid property being a physical property of the fluid that distinguishes between mud filtrate and virgin fluid;

detecting stabilization of the property of the fluid in the evaluation flowline;

establishing a combined flowline from the evaluation and cleanup flowlines; and estimating at least one future fluid property for the combined flowline.

* * * * *